United States Patent [19]

Ishikawa et al.

[11] Patent Number: 4,960,684

[45] Date of Patent: Oct. 2, 1990

[54] METHOD FOR PROCESSING SILVER HALIDE COLOR PHOTOGRAPHIC MATERIALS

[75] Inventors: Takatoshi Ishikawa; Hiroshi Fujimoto; Morio Yagihara; Kazuto Andoh, all of Kanagawa, Japan

[73] Assignee: Fuji Photo Film Co., Ltd., Kanagawa, Japan

[21] Appl. No.: 299,592

[22] Filed: Jan. 23, 1989

[30] Foreign Application Priority Data

Jan. 21, 1988 [JP] Japan ..... 63-11287
Jan. 21, 1988 [JP] Japan ..... 63-11297

[51] Int. Cl.[5] ..... G03C 7/00; G03C 7/30

[52] U.S. Cl. ..... 430/467; 430/372; 430/380; 430/468; 430/490; 430/491

[58] Field of Search ..... 430/370, 490, 491, 380, 430/467, 468

[56] References Cited

U.S. PATENT DOCUMENTS 4,264,716 4/1981 Vincent et al. ..... 430/357
4,693,956 9/1987 Marchesano ..... 430/468
4,801,521 1/1989 Ohki et al. ..... 430/380

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A silver halide color photographic material is processed with a color developer containing at least one compound of the following formula (I) and at least one compound of the following formula (II):

(I)

where $R^1$, $R^2$ and $R^3$ independently represents a hydrogen atom, an alkyl group, an aryl group or a heterocyclic group;

$R^4$ represents a hydrogen atom, a hydroxyl group, a hydrazino group, an alkyl group, an aryl group, a heterocyclic group, an alkoxy group, an aryloxy group, a carbamoyl group or an amino group;

$X^1$ represents a divalent group;

n represents 0 or 1; and when is 0, $R^4$ represents an alkyl group, an aryl group or a heterocyclic group; and $R^3$ and $R^4$ may together form a heterocyclic group;

(II)

where Z represents an atomic group necessary for completing an aromatic nucleus.

16 Claims, No Drawings

METHOD FOR PROCESSING SILVER HALIDE COLOR PHOTOGRAPHIC MATERIALS

FIELD OF THE INVENTION

The present invention relates to a method for processing a silver halide color photographic material and, in particular, to a method where the stability of the color developer is extremely improved and increases of stain and variation of sensitivity are noticeably suppressed, even in processing with a color developer which has been stored for a long time or in continuous processing.

BACKGROUND OF THE INVENTION

A color developer containing an aromatic primary amine color developing agent has hitherto been utilized for the formation of photographic color images, and at present, it plays a major role in the image formation method in color photography. However, this color developer has a problem in that it is extremely easily oxidized with air or metals, and it is well known that the use of the oxidized developer for the formation of color images causes an increase of stain and fluctuation of sensitivity or gradation with the result that the desired photographic characteristic can not be obtained.

In view of the above situation, various means have heretofore been investigated so as to improve the preservability of color developers, and among them, a method of using both hydroxylamine and a sulfite ion has been most generally used. However, hydroxylamine yields ammonia, when decomposed, to cause fluctuation of gradation, while the hydroxylamine and sulfite ion reactively compete with the developing agent and thereby interfere with the coloring property of the developing agent. Accordingly, it is difficult to say that both of these compounds are preferred as a preservative for improving the preservability of the color developer.

Under the circumstances, various preservative have been investigated as substitutes for hydroxylamine and sulfite ions. For instance, there are mentioned the hydroxycarbonyl compounds described in U.S. Pat. No. 3,615,503 and British Patent No. 1,306,176, the α-aminocarbonyl compounds described in JP-A-52-143020 and JP-A-53-89425 (the term "JP-A" as used herein means an "unexamined published Japanese patent application") and the hydroxamic acids described in JP-A-52-27638, all of which, however, can not be said to be sufficient in the preservative capacity thereof, though they have little influence on the photographic characteristics in photographic processing. Especially in continuous processing in an automatic developing machine, if the amount of the photographic material to be processed is small or if the residence time of the replenisher to be applied to the machine is too long in the replenisher tank, the preservative compound would often have some harmful influence on the photographic characteristics in the photographic processing. Regarding the aromatic polyhydroxy compounds described in JP-A-56-47038 and U.S. Pat. Nos. 4,264,716 and 3,764,544, these are used in combination with hydroxylamine so as to inhibit decomposition of the hydroxylamine and to improve the stability of the processing liquid used. However, hydroxylamine has an influence on the coloring property of developing agents, as mentioned above, and is therefore unfavorable. In addition, the above-mentioned conventional hydroxylamine substitutes do not display a sufficient preservative capacity even when they are used in combination with aromatic polyhydroxy compounds.

As chelating agents, there are mentioned, for example, the aminopolycarboxylic acids described in JP-B-48-30496 and JP-B-44-30232, the organic phosphonic acids described in JP-A-56-97347, JP-B-56-39359 (the term "JP-B" as used herein means an "examined Japanese patent publication") and West German Patent 2,227639, the phosphonocarboxylic a ids described in JP-A-52-102726, JP-A-53-42730, JP-A-54-121127, JP-A-55-126241 and JP-A-55-65956 and the compounds described in JP-A-58-195845 and JP-A-58-203440 and JP-B-53-40900.

However, even though these compounds were used, sufficient preservative capacity still could not be attained, and these compounds were ineffective for stabilization of the photographic characteristics in continuous photographic processing.

SUMMARY OF THE INVENTION

One object of the present invention is to provide a method for processing a silver halide color photographic material with a color developer which has improved stability (in particular, the preservative in the developer being prevented from being deteriorated by heat or metals when the liquid opening ratio is small).

Another object of the present invention is to provide a method for processing a silver halide color photographic material in which an increase in stain and fluctuation of sensitivity during continuous processing are noticeably reduced.

The above objects are attained by a method for processing a silver halide color photographic material with a color developer which contains at least one compound of the following general formula (I) and at least one compound of the following general formula (II):

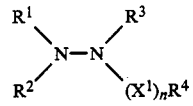

(I)

where $R^1$, $R^2$ and $R^3$ independently represent a hydrogen atom, an alkyl group, an aryl group or a heterocyclic group;

$R^4$ represents a hydrogen atom, a hydroxyl group, a hydrazino group, an alkyl group, an aryl group, a heterocyclic group, an alkoxy group, an aryloxy group, a carbamoyl group or an amino group;

$X^1$ represents a divalent group;

n represents 0 or 1, provided that when n is 0, $R^4$ represents an alkyl group, an aryl group or a heterocyclic group; and $R^3$ and $R^4$ may together form a heterocyclic group

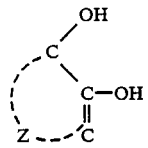

(II)

where Z represents an atomic group which completes and forms an aromatic nucleus.

DETAILED DESCRIPTION OF THE INVENTION

The method of the present invention is especially effective in processing a silver halide color photographic material having at least one or more emulsion layers substantially comprising silver chloride. The "emulsion layer substantially comprising silver chloride" as referred to herein means that 95% or more, preferably 98% or more, of the entire silver halide in the emulsion layer is silver chloride By combination of the hydrazine compound of formula (I) and the aromatic polyhydroxy compound of formula (II), the processing liquid stability has specifically been improved almost with no influence on the photographic characteristics thereof (especially yellow-sensitivity and fluctuation of "fog"), which is surprising and is to be specifically noted.

Further, addition of an organic phosphonic acid chelating agent can augment the effect of improving the liquid stability, which is a quite unexpected finding. Color developers are known to contain various chelating agents. However, it was unexpected that incorporation of an organic phosphonic acid chelating agent into the color developer containing the compound of the formula (I) resulted in an improvement in attaining the above objects and that addition of the compound of the formula (II) to the color developer resulted in a still more remarkable result in attaining the above objects.

Especially when a processing liquid is stored under the condition having a relatively small liquid opening ratio (for example, having a liquid opening ratio of 0.20 $cm^{-1}$ or less, especially from 0 to 0.05 $cm^{-1}$), such as a color developer replenisher in a replenisher tank in an automatic developing machine, or when metal ions (especially heavy metal ions such as Fe or Cu) would exist in the processing liquid, such as occurs when metal ions are released from water used for preparing the liquid or from processing chemicals used, for example, in a concentration of 0.05 ppm or more, especially from 1 to 3 ppm, the effect resulting from the combination of the compounds of formulae (I) and (II) is extremely noticeable.

The "liquid opening ratio" as referred to herein is represented by the following formula:

$$\text{Liquid Opening Ratio} = \frac{\text{Air Contact Area (cm}^2\text{) of Processing Liquid}}{\text{Entire Volume (cm}^3\text{) of Processing Liquid}}$$

The compounds of formula (I) to be used in the present invention, which are hydrazines and hydrazine analogues such as hydrazides, will be mentioned in detail hereunder.

$R^1$, $R^2$ and $R^3$ independently represent a hydrogen atom, a substituted or unsubstituted alkyl group (preferably having from 1 to 20 carbon atoms, such as methyl, ethyl, sulfopropyl, carboxybutyl, hydroxyethyl, cyclohexyl, benzyl, phenethyl), a substituted or unsubstituted aryl group (preferably having from 6 to 20 carbon atoms, such as phenyl, 2,5-dimethoxyphenyl, 4-hydroxyphenyl, 2-carboxyphenyl), or a substituted or unsubstituted heterocyclic group (preferably having from 1 to 20 carbon atoms and preferably in the form of a 5-membered or 6-membered ring having at least one hetero atom selected from oxygen, nitrogen and sulfur, such as pyridin-4-yl, N-acetylpiperidin-4-yl).

$R^4$ represents a hydrogen atom, a hydroxyl group, a substituted or unsubstituted hydrazino group (e.g., hydrazino, methylhydrazino, phenylhydrazino), a substituted or unsubstituted alkyl group (preferably having from 1 to 20 carbon atoms, such as methyl, ethyl, sulfopropyl, carboxybutyl, hydroxyethyl, cyclohexyl, benzyl, t-butyl, n-octyl), a substituted or unsubstituted aryl group (preferably having from 6 to 20 carbon atoms, such as phenyl, 2,5-dimethoxyphenyl, 4-hydroxyphenyl, 2-carboxyphenyl, 4-sulfophenyl), a substituted or unsubstituted heterocyclic group (preferably having from 1 to 20 carbon atoms and preferably in the form of a 5-membered or 6-membered ring having at least one hetero atom selected from oxygen, nitrogen and sulfur, such as pyridin-4-yl, imidazolyl), a substituted or unsubstituted alkoxy group (preferably having from 1 to 20 carbon atoms, such as methoxy, ethoxy, methoxyethoxy, benzyloxy, cyclohexyloxy, octyloxy), a substituted or unsubstituted aryloxy group (preferably having from 6 to 20 carbon atoms, such as phenoxy, p-methoxyphenoxy, p-carboxyphenoxy, p-sulfophenoxy), a substituted or unsubstituted carbamoyl group (preferably having from 1 to 20 carbon atoms, such as unsubstituted carbamoyl, N,N-diethylcarbamoyl, phenylcarbamoyl), or a substituted or unsubstituted amino group (preferably having from 0 to 20 carbon atoms, such as amino, hydroxyamino, methylamino, hexylamino, methoxyethylamino, carboxyethylamino, sulfoethylamino, N-phenylamino, p-sulfophenylamino).

$R^1$, $R^2$, $R^3$ and $R^4$ may be substituted, for example, by substituent(s) selected from a halogen atom (e.g., chlorine, bromine), a hydroxyl group, a carboxyl group, a sulfo group, an alkoxy group, an amido group, sulfonamido group, a carbamoyl group, a sulfamoyl group, an alkyl group, an aryl group, an aryloxy group, an alkylthio group, an arylthio group, a nitro group, a cyano group, a sulfonyl group and a sulfinyl group, and these substituent groups may also be substituted further.

$X^1$ represents preferably a divalent organic residue, for example, $$-CO-,\ -SO_2-\ \text{or}\ -\overset{\overset{\displaystyle NH}{\|}}{C}-.$$

n represents 0 or 1. When n is 0, R4 is a group selected from a substituted or unsubstituted alkyl group, aryl group and heterocyclic group. $R^1$ and $R^2$, and $R^3$ and $R^4$ may together form a heterocyclic group.

When n is 0, at least one of $R^1$ to $R^4$ is preferably a substituted or unsubstituted alkyl group. Especially preferably, $R^1$, $R^2$, $R^3$ and $R^4$ each is a hydrogen atom or a substituted or unsubstituted alkyl group, provided that all $R^1$, $R^2$, $R^3$ and $R^4$ are other than hydrogen atoms at the same time. Especially preferably, $R^1$, $R^2$, and $R^3$ each is a hydrogen atom and $R^4$ is a substituted or unsubstituted alkyl group; or $R^1$ and $R^3$ each is a hydrogen atom and $R^2$ and $R^4$ each is a substituted or unsubstituted alkyl group; or $R^1$ and $R^2$ each is a hydrogen atom and $R^3$ and $R^4$ each is a substituted or unsubstituted alkyl group (or $R^3$ and $R^4$ may together form a hetero ring).

When n is 1, $X^1$ is preferably —CO—, $R^4$ is preferably a substituted or unsubstituted amino group, and $R^1$ to $R^3$ each is preferably a hydrogen atom, and a substituted or unsubstituted alkyl group.

The alkyl group for $R^1$ to $R^4$ is preferably one having from 1 to 10 carbon atoms, more preferably from 1 to 7 carbon atoms. As preferred substituents for the alkyl group, there may be mentioned a hydroxyl group, a carboxylic acid group, a sulfone group and a phosphonic acid group. When the alkyl group has two or more substituents, they may be same or different.

The compound of formula (I) may be in the form of a bis-, tris- or polymer, which is linked at the position of $R^1$, $R^2$, $R^3$ and/or $R^4$.

Specific examples of the compounds of formula (I) are mentioned below, which, however, are not intended to restrict the scope of the present invention.

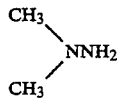
(I-1)

$CH_3NHNHCH_3$ (I-2)

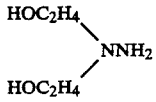
(I-3)

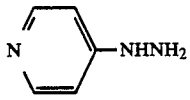
(I-4)

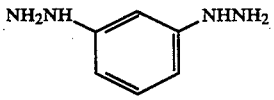
(I-5)

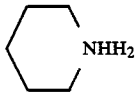
(I-6)

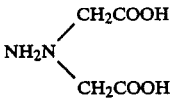
(I-7)

$HOOCCH_2NHNHCH_2COOH$ (I-8)

$NH_2NH\text{-}(CH_2)_3\text{-}NHNH_2$ (I-9)

$NH_2NHCH_2CH_2OH$ (I-10)

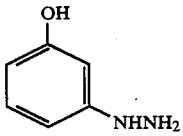
(I-11)

$NH_2NH\text{—}(CH_2)_3\text{—}SO_3H$ (I-12)

$NH_2NH\text{—}(CH_2)_4\text{—}SO_3H$ (I-13)

$NH_2NH\text{—}(CH_2)_3\text{—}COOH$ (I-14)

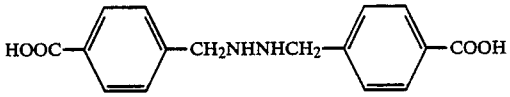
(I-15)

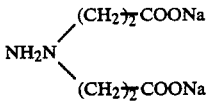
(I-16)

-continued

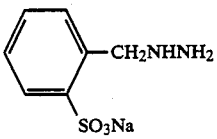
(I-17)

$NaOOCCH(CH_3)NHNHCH(CH_3)COONa$ (I-18)

$NH_2NHCH_2CH_2COONa$ (I-19)

$NH_2NHCH_2COONa$ (I-20)

$H_2NNHCH_2CH_2SO_3Na$ (I-21)

$H_2NNH\text{-}CH(C_4H_9(n))COOH$ (I-22)

$H_2NNH\text{-}CH(C_6H_{13}(n))COOH$ (I-23)

$H_2NN\text{-}(CH(C_4H_9(n))COOH)_2$ (I-24)

$H_2NN\text{-}(CH_2CH_2SO_3Na)_2$ (I-25)

$H_2NN\text{-}(CH_2CH_2CH_2SO_3Na)_2$ (I-26)

$H_2NN\text{-}(CH(C_2H_5)COOH)_2$ (I-27)

$H_2NNH\text{-}CH(CH_3)COOH$ (I-28)

$H_2NN(CH_2CH_2OH)(CH_2COOH)$ (I-29)

$H_2NNHCH_2CH_2N(CH_3)_2$ (I-30)

$H_2NN\text{-}(CH_2CH_2N(CH_3)_2)_2$ (I-31)

$\text{-}(CH_2\text{—}N(NH_2)\text{—}CH_2CH_2)_n\text{-}$ (I-32)

(mean molecular weight: about 4,000)

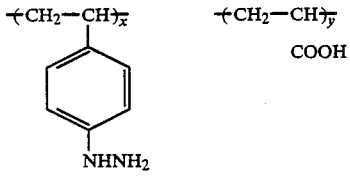
(I-33)

(x:y = 60:40, mean molecular weight: about 20,000)

$NH_2NHCONH_2$ (I-34)

$NH_2NHC(=NH)NH_2$ (I-35)

$NH_2NHCONHNH_2$ (I-36)

$NH_2NHSO_3H$ (I-37)

$NH_2NHSO_2NHNH_2$ (I-38)

$CH_3NHNHSO_2NHNHCH_3$ (I-39)

$NH_2NHCONH\text{—}(CH_2)_3\text{—}NHCONHNH_2$ (I-40)

-continued (I-41)

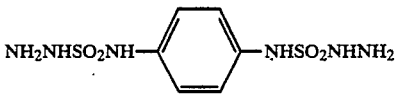

(I-42)

$NH_2NHCOCONHNH_2$ (I-43)

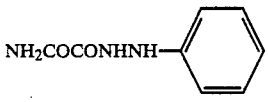

(I-44)

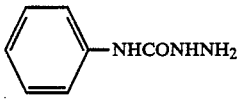

(I-45)

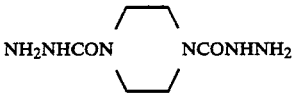

(I-46)

$NH_2COCONHNH_2$ (I-47)

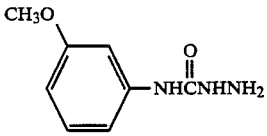

(I-48)

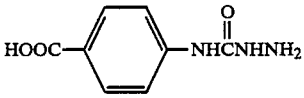

As examples other than the above-mentioned compounds for formula (I), there may further be mentioned the compounds described in JP-A-63-146041, JP-A-63-146042 and JP-A-63-146043.

Most of the compounds of formula (I) are commercially available or can easily be produced in accordance with various general methods, for example, as described in *Organic Synthesis,* Coll. Vol. 2, pages 208 to 213; *Jour. Amer. Chem. Soc.,* 36, 1747 (1914); *Oil Chemistry,* 24, 31 (1975); *Jour. Org. Chem.,* 25, 44 (1960); *Journal of Pharmacology,* 91, 1127 (1971); *Organic Synthesis,* Coll. Vol. 1, page 450; *New Lecture of Experimental Chemistry,* Vol. 14, III, pages 1621 to 1628 (published by Maruzen, Japan); *Beil.,* 2, 559; *Beil.,* 3, 117; E.B. Mohr et al, *Inorg. Syn.,* 4, 32 (1953); F.J. Wilson, E.C. Pickering, *J. Chem. Soc.,* 123, 394 (1923); N.J. Leonard, J.H. Boyer, *J. Org. Chem.,* 15, 42 (1950); *Organic Synthesis,* Coll. Vol. 5, page 1055; P.A.Ş. Smith, *Derivatives of Hydrazine and Other Hydronitroqens Havinq N-Bonds,* pages 120 to 124 and pages 130 and 131, THE BENJAMIN/CUMMINGS COMPANY, (1983); Staniey R., Sandier Waif Karo, *Organic Functional Group Preparations,* Vol. 1, Second Edition, page 457.

The hydrazine or hydrazide compound of formula (I) is incorporated into a color developer in an amount of from 0.01 to 50 g, preferably from 0.1 to 30 g, more preferably from 0.5 to 10 g, per liter of color developer.

Next, the compounds of formula (II) will be explained in detail.

In general, aromatic polyhydroxy compounds are ones having at least two hydroxyl groups which are ortho-positioned to each other on the aromatic ring. Preferably, such polyhydroxy compounds are ones having at least two hydroxyl groups which are ortho-positioned to each other on the aromatic ring, but not having any unsaturated bond outside the ring. The aromatic polyhydroxy compounds for use in the present invention cover a broad range and include benzene or naphthalene compounds as represented by the following general formula:

(II)

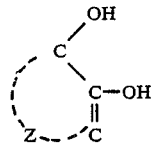

where Z represents an atomic group necessary for completing a benzene or naphthalene aromatic nucleus.

The above-mentioned compounds may further be substituted by additional group(s) or atom(s), such as a sulfo group, a carboxyl group, or a halogen atom, in addition to the hydroxyl substituents.

Specific examples of the aromatic polyhydroxy compounds which are preferably used in the present invention are shown below.

II-1: Pyrocatechol
II-2: 4,5-Dihydroxy-m-benzene disulfonic Acid
II-3: 4,5-Dihydroxy-m-benzene-disulfonic Acid Disodium Salt
II-4: Tetrabromopyrocatechol
II-5: Pyrogallol
II-6: 5,6-Dihydroxy-1,2,4 benzenetrisulfonic Acid Sodium Salt
II-7: Gallic Acid
II-8: Methyl Gallate
II-9: Propyl Gallate
II-10: 2,3-Dihydroxynaphthalene-6-sulfonic Acid
II-11: 2,3,8-Trihydroxynaphthalene-6-sulfonic Acid The compound of formula (II) may be incorporated into a color developer, and the amount thereof is from 0.00005 to 0.1 mol, generally from 0.0002 to 0.04 mol, preferably from 0.0002 to 0.004 mol, per liter of developer.

The color developer for use in the method of the present invention preferably contains an organic phosphonic acid chelating agent, which will be explained in detail hereunder.

Any and every organic phosphonic acid, including alkylphosphonic acids, phosphono-carboxylic acids and aminopolyphosphonic acids, may be used in the present invention. Especially preferably alkylphosphonic acids and aminopolyphosphonic acids are used, which may be represented by the following general formulae (III) to (XI).

$$B-A_1-Z-A_2-C \quad \text{(III)}$$

(IV)

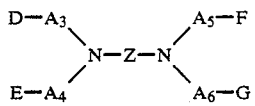

In these formulae (III) and (IV), $A_1$ to $A_6$ each represent a substituted or unsubstituted alkylene group; Z represents an alkylene group, a cyclohexylene group, a phenylene group, -R-O-R, -ROROR-,

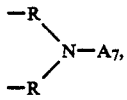

where R is an alkylene group, or >N—$A_7$, where $A_7$ is a hydrogen atom, a hydrocarbon group, a lower aliphatic carboxylic acid residue or a lower alcohol residue;

B, C, D, E, F and G each represent —OH, —COOM, —$PO_3M_2$, where M is a hydrogen atom, an alkali metal or an ammonium group; and at least one of B, C, D, E, F, and G is —$PO_3M_2$.

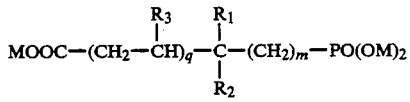

(V)

where $R_1$ represents —COOM or —$PO(OM)_2$;

$R_2$ represents a hydrogen atom, an alkyl group having from 1 to 4 carbon atoms, —$(CH_2)_{n'}$—COOM or a phenyl group;

$R_3$ represents a hydrogen atom or —COOM;

M represents a hydrogen atom, an alkali metal or an ammonium group;

m represents 0 or 1;

n' represents an integer of from 1 to 4;

q represents 0 or 1;

provided that when m is 0, $R_1$ is —$PO(OM)_2$.

$R_4N(CH_2PO_3M_2)_2$ (VI)

where $R_4$ represents a lower alkyl group, an aryl group, an aralkyl group or a nitrogen-containing 6-membered heterocyclic group, which may be substituted by one or more substituents selected from —OH, —$OR_5$, where $R_5$ is an alkyl group having from 1 to 4 carbon atoms, —$PO_3M_2$, —$CH_2PO_3M_2$, —$N(CH_2PO_3M_2)_2$, —$COOM_2$ and —$N(CH_2COOM_2)$;

M represents a hydrogen atom, an alkali metal or an ammonium group.

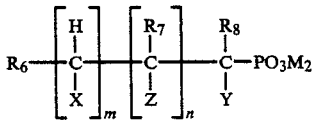

(VII)

where $R_6$ and $R_7$ each represents a hydrogen atom, a lower alkyl group, —COOH or —$NJ_2$, where J is —H, —OH, a lower alkyl group or —$C_2H_4OH$;

$R_8$ represents a hydrogen atom, a lower alkyl group, —OH or —$NL_2$, where L is —H, —OH, —$CH_3$, —$C_2H_5$, —$C_2H_4OH$ or —$PO_3M_2$: X, Y and Z each represent —OH, —COOM, —$PO_3M_2$ or —H:

M represents a hydrogen atom, an alkali metal or an ammonium group;

n represents 0 or an integer of 1 or more;

m represents 0 or 1.

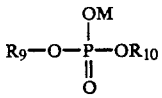

(VIII)

where $R_9$ and $R_{10}$ each represent a hydrogen atom, an alkali metal, an ammonium group or a substituted or unsubstituted alkyl, alkenyl or cyclic alkyl group having from 1 to 12 carbon atoms, and M represents a hydrogen atom, an alkali metal or an ammonium group;

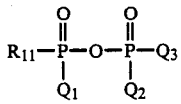

(IX)

where $R_{11}$ represents an alkyl group having from 1 to 12 carbon atoms, an alkoxy group having from 1 to 12 carbon atoms, a monoalkylamino group having from 1 to 12 carbon atoms, a dialkylamino group having from 2 to 12 carbon atoms, an amino group, an aryloxy group having from 1 to 24 carbon atoms, an arylamino group having from 6 to 24 carbon atoms or an acyloxy group;

$Q_1$ to $Q_3$ each represents —OH, an alkoxy, aralkyloxy or aryloxy group having from 1 to 24 carbon atoms, —$OM_3$, where $M_3$ is a cation, an amino group, a morpholino group, a cyclic amino group, an alkylamino group, a dialkylamino group, an arylamino group or an alkyloxy group.

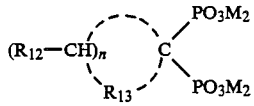

(X)

where $R_{12}$ and $R_{13}$ each represents a hydrogen atom, a lower alkyl group or an imino group, which may optionally be substituted by a lower alkyl group or —$CH_2CH_2COONa$;

M represents a hydrogen atom, an alkali metal or an ammonium group;

n represents an integer of from 2 to 16.

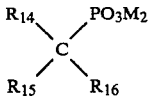

(XI)

where $R_{14}$ to $R_{16}$ each is a hydrogen atom or an alkyl group, which may have at least one substituent selected from —OH, —$OC_{n''}H_{2n''}+1$, where n'' is 1 to 4, —$PO_3M_2$, —$CH_2PO_3M$, —$NR_2$, where R is an alkyl qroup) and —$N(CH_2PO_3M_2)_2$; and M represents a hydrogen atom, an alkali metal or an ammonium group.

Among the above compounds, those represented by the formulae (IV) and (VII) are preferred.

Specific examples of the chelating compounds of the aforesaid formulae (III) to (XI) are shown below by chelating agents (1) to (68), which, however, are not intended to restrict the scope of the present invention.

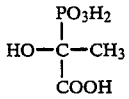

(1)

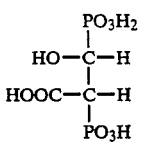

(2)

-continued
(3)
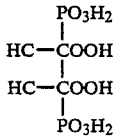
(4)
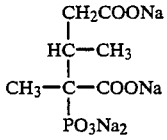
(5)
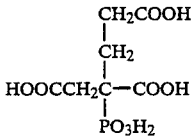
(6)
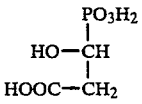
(7)
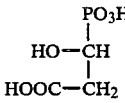
(8)
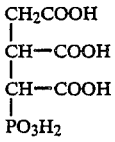
(9)
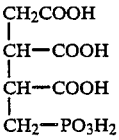
(10)
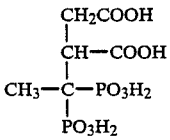
(11)
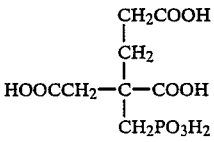
(12)
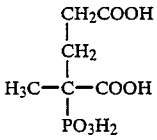
(13)
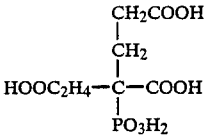
-continued
(14)
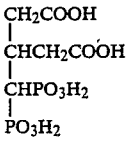
(15)
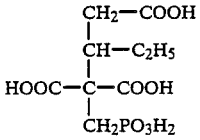
(16)
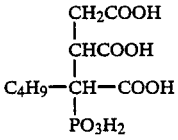
(17)
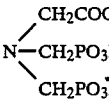
(18)
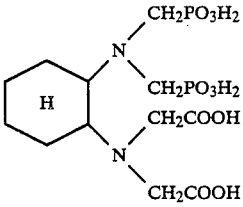
(19)
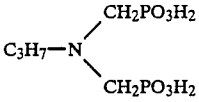
(20)
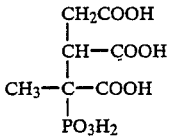
(21)
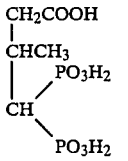
(22)
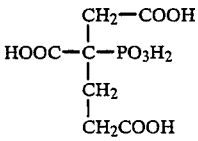
(23)
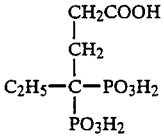
(24)
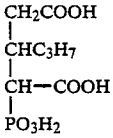

-continued
(25)
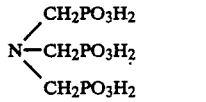
(26)
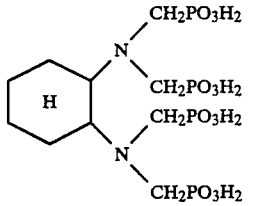
(27)
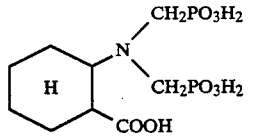
(28)
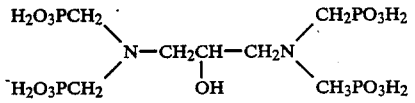
(29)
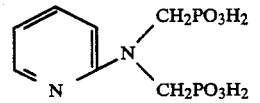
(30)
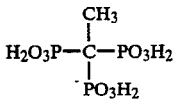
(31)
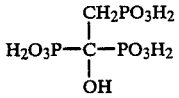
(32)
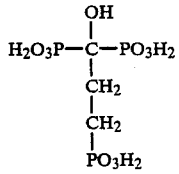
(33)
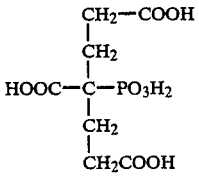
(34)
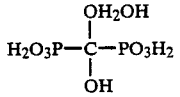
(35)
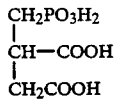
-continued
(36)
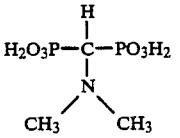
(37)
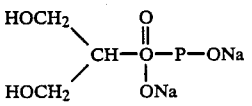
(38)
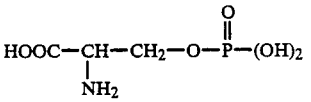
(39)
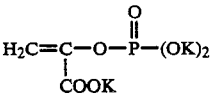
(40)
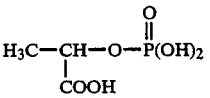
(41)
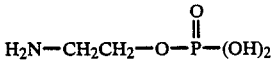
(42)
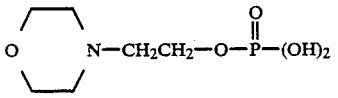
(43)
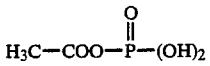
(44)
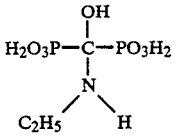
(45)
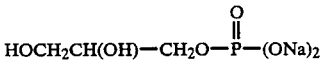
(46)
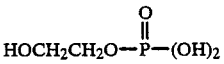
(47)
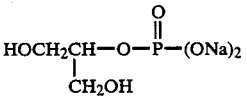
(48)
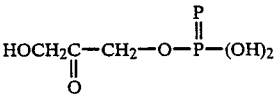
(49)
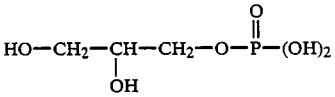
(50)
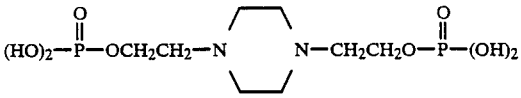

-continued (51)

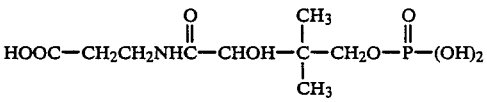

(52)

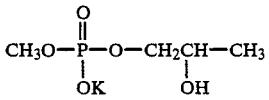

(53)

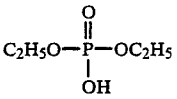

(54)

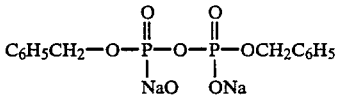

(55)

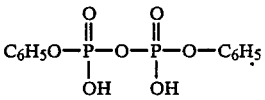

(56)

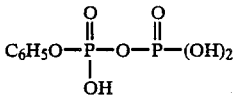

(57)

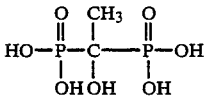

(58)

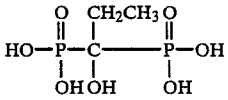

(59)

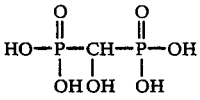

(60)

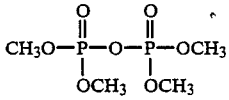

(61)

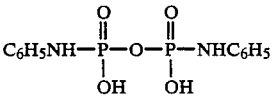

(62)

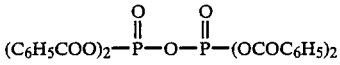

(63)

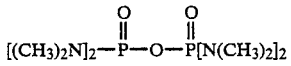

(64)

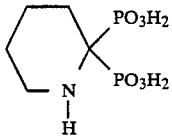

-continued (65)

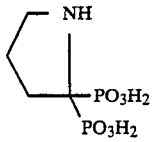

(66)

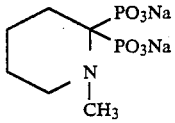

(67)

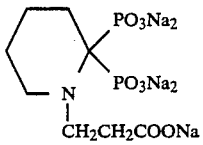

(68)

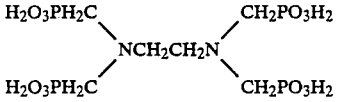

The amount of the organic phosphonic acid chelating agent to be added to the color developer for use in the present invention is from 0.01 to 20 g, more preferably from 0.1 to 10 g, per liter of the developer.

If desired, any other chelating agent may also be added to the color developer for use in the present invention in such amount that would not interfere with the effect of the present invention. Examples of further chelating agents which may be used in the present invention include nitrilotriacetic acid, diethylenetriaminepentaacetic acid, ethylenediaminetetraacetic acid, trans cyclohexanediaminetetraacetic acid, 1,2-diaminopropanetetraacetic acid, glycoletherdiaminetetraacetic acid, ethylenediamine-orthohydroxyphenylacetic acid, N,N'-bis(2-hydroxybenzyl)ethylenediamine-N,N'-diacetic acid and hydroxyethyliminodiacetic acid. However, these are not limitative.

The color developer for use in the present invention contains a color developing agent, and preferred examples of the agent are p-phenylenediamine compounds. Specific examples of these compounds are mentioned below, which, however, are not limitative.

D-1: N,N-diethyl p-phenylenediamine
D-2: 2-Amino-5-diethylaminotoluene
D-3: 2-Amino-5-(N-ethyl-N-laurylamino)toluene
D-4: 4-[N-ethyl-N-(8-hydroxyethyl)amino]aniline
D-5: 2-Methyl-4-[N-ethyl-N-(8-hydroxyethyl)-amino]aniline
D-6: 4-Amino-3-methyl-N-ethyl-N-[β-(methane-sulfonamido)ethyl]aniline
D 7: N-(2-amino-5-diethylaminophenylethyl)-methanesulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline The p-phenylenediamine compounds may also be in the form of salts such as sulfates, hydrochlorides, sulfites or p-toluenesulfonates. The amount of the aromatic primary amine developing agent to be contained in the color developer is preferably from about 0.1 g to about 20 g, more preferably from about 0.5 g to about 10 g, per liter of the developer.

The color developer for use in the present invention can further contain, if desired, sulfites, such as sodium sulfite, potassium sulfite, sodium bisulfite, potassium bisulfite, sodium metasulfite or potassium metasulfite, as well as carbonylsulfite adducts, as a preservative. However, the amount of the sulfite ion in the color developer is preferably as small as possible, so that the developer may have a higher coloring capacity.

As compounds capable of directly preserving the aforesaid color developing agents, various hydroxylamines, the hydroxamic acids described in JP-A-63-43138, the phenols described in JP-A-63-44657 and JP-A-63-58443, the α-hydroxyketones and α-aminoketones described in JP-A-63-44656 and/or various saccharides described in JP-A-63-36244 are preferably added to the color developer. Further, in combination with the above preservative compounds, the monoamines described in JP-A-63-4235, JP-A-63-24254, JP-A-63-21647, JP-A-63-27841, JP-A-63 25654, and JP-A-63-146040, and the diamines described in JP-A-63-30845, JP-A-63-146060 and JP-A-63-43139, the polyamines described in JP-A-63-21647 and JP-A-63-26655, the polyamines described in JP-A-63-44655, the nitroxy radicals described in JP-A-63-53551, the alcohols described in JP-A-63-43140 and JP-A-63-53549, the oximes described in JP-A-63-56654 and the tertiary amines described in EP-A-266797 may preferably be used.

As other preservatives which may be used in the present invention, there are preferably mentioned various metals described in JP-A-57-44148 and JP-A-57-53749, the salicylic acids described in JP-A-59-180588, the alkanolamines described in JP-A-54-3532, the polyethyleneimines described in JP-A-56-94349 and the compounds described in EP-A-266797.

The color developer for use in the present invention preferably has a pH value of from 9 to 12, more preferably from 9 to 11.0, and the color developer can contain various known developer components in addition to the above-mentioned ingredients.

In order to maintain the above pH value, the color developer preferably contains various kinds of buffers. The buffers which are usable include, for example, carbonic acid salts, phosphoric acid salts, boric acid salts, tetraboric acid salts, hydroxy-benzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, tris-hydroxyaminomethane salts, lysine salts, etc. In particular, carbonic acid salts, phosphoric acid salts, tetraboric acid salts and hydroxybenzoic acid salts are advantageous in that they have excellent solubility and have an excellent buffering capacity in a high pH range of pH 9.0 or more, and therefore even when they are added to the color developer, they have no bad influence on the photographic property (for example, fog, etc.). In addition, they are inexpensive. Accordingly, the use of these buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, these compounds are not intended to restrict the scope of the present invention.

The amount of the buffer to be added to the color developer is preferably 0.1 mol/liter or more, and is especially preferably from 0.1 mol/liter to 0.4 mol/liter.

The color developer may contain an optional development accelerator, if desired. However, it is preferred that the color developer of the present invention does not substantially contain benzyl alcohol, in view of preventing environmental pollution, the easiness of preparing the developer solution and preventing fog. The wording "does not substantially contain benzyl alcohol" means that the amount of benzyl alcohol in the developer is 2 ml/liter or less, or preferably the developer contains no benzyl alcohol.

The above-mentioned compounds to be used in the present invention display an extremely excellent effect in a processing step using a color developer substantially not containing benzyl alcohol.

As other development accelerators which can be added to the color developer for use in the present invention, there may be mentioned, for example, the thioether compounds described in JP-B-37-16088, JP B-37-5978, JP-B-38-7826, JP-B-44-12380 and JP-B-45-9019 and U.S. Pat. No. 3,813,247, the p-phenylenediamine compounds described in JP-A-52-49829 and JP-A-50-15554, the quaternary ammonium salts described in JP-A-50-137726, JP-B-44-30074, JP-A-56-156826 and JP-A-52 43429, the amine compounds described in U.S. Pat. Nos. 2,494,903, 3,128,182, 4,230,796 and 3,253,919, JP-B-41-11431 and U.S. Pat. Nos. 2,482,546, 2,596,926 and 3,582,346, the polyalkylene oxides described in JP-B-37-16088 and JP-B-42-25201, U.S. Pat. No. 3,128,183, JP-B-41-11431 and JP-B- 42-23883 and U.S. Pat. No. 3,532,501, as well as other 1-phenyl-3-pyrazolidones and imidazoles. These compounds can be used, if desired.

In accordance with the present invention, any optional antifoggant can be added to the color developer, if desired. As the antifoggant there can be used alkali metal halides such as sodium chloride, potassium bromide or potassium iodide, as well as organic antifoggants. Specific examples of organic antifoggants which may be used in the present invention include nitrogen-containing heterocyclic compounds such as benzotriazole, 6 nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethylbenzimidazole, indazole, hydroxyazaindolidine and adenine.

The color developer for use in the present invention preferably contains a brightening agent. Preferred examples of the brightening agent include 4,4'-diamino-2,2'-disulfostylbene compounds. The amount of the brightening agent to be added to the color developer is up to 5 g/liter, preferably from 0.1 to 4 g/liter.

In addition, various kinds of surfactants can be added to the color developer, if desired, including alkylsulfonic acids, arylsulfonic acids, aliphatic carboxylic acids, aromatic carboxylic acids, etc.

The processing temperature of the color developer of the present invention is from 20° to 50° C., preferably from 30° to 40° C. The processing time is from 20 seconds to 5 minutes, preferably from 30 seconds to 2 minutes. The amount of the replenisher is preferably small and is, for example, from 20 to 600 ml, preferably from 50 to 300 ml, more preferably from 100 to 200 ml, per $m^2$ of the photographic material which is being processed.

Next, the desilvering step in the process of the present invention will be explained hereunder. For the desilvering step, anyone of a bleaching step/fixation step; fixation step/bleach-fixation step; bleaching step/bleach-fixation step; and bleach-fixation step can be employed. In accordance with the present invention, the time for the desilvering step is preferably as small as possible, whereby the effect of the present invention is more remarkable. That is, the time for the desilvering step is 2 minutes or less, more preferably from 15 seconds to 60 seconds.

Desilvering Step

A bleaching solution, bleach-fixing solution and fixing solution which can be used in the desilvering step in the process of the present invention .will be explained hereunder.

Any and every bleaching agent can be used in the bleaching solution or bleach-fixing solution for use in the present invention. In particular, organic complex salts of iron(III) (for example, complex salts with aminopolycarboxylic acids such as ethylenediaminetetraacetic acid or diethylenetriamine-pentaacetic acid, or with aminopolyphosphonic acids, phosphonocarboxylic acids or organic phosphonic acids) or organic acids such as citric acid, tartaric acid or malic acid; persulfates; and hydrogen peroxide are preferred as the bleaching agent.

Among them, the organic complex salts of iron(III) are especially preferred in view of the rapid processability thereof and of preventing environmental pollution. Examples of aminopolycarboxylic acids, aminopolyphosphonic acids or organic phosphonic acids or their salts which are useful for formation of organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycolether-diaminetetraacetic acid.

These compounds may be in any form of their sodium, potassium, lithium or ammonium salts. Among these compounds, iron(III) complex salts of ethylenediamine-tetraacetic acid, diethylenetriamine-pentaacetic acid, cyclohexanediaminetetraacetic acid, 1,3-diaminopropanetetraacetic acid or methyliminodiacetic acid are especially preferred, as these have a high bleaching capacity.

These ferric complex salts can be used in the form of the complex salts themselves, or alternatively, a ferric salt, such as ferric sulfate, ferric chloride, ferric nitrate, ferric ammonium sulfate or ferric phosphate, and a chelating agent, such as aminopolycarboxylic acids, aminopolyphosphonic acids or phosphonocarboxylic acids, can be added to the developer solution so that the intended ferric complex salt can be formed in the solution. The chelating agent can be used in an excess amount exceeding the necessary amount for the formation of the ferric complex salt. Among the iron complexes, the aminopolycarboxylic acid/iron complexes are preferred, and the amount of the complex to be added to the developer is from 0.01 to 1.0 mol/liter, preferably from 0.05 to 0.50 mol/liter.

In the bleaching or bleach-fixing solution and/or the previous bath, various kinds of compounds can be incorporated as a bleaching accelerating agent. For example, the mercapto group- or disulfido group-containing compounds described in U.S. Pat. No. 3,893,858, West German Patent No. 1,290,812, JP-A-53-95630 and *Research Disclosure,* Item 17129 (July, 1978); the thiourea compounds described in JP-B-45-8506, JP-A-52-20832 and JP-A-53-32735 and U.S. Pat. No. 3,706,561; as well as halides such as iodides or bromides are preferred for the above purpose, as having an excellent bleaching capacity.

In addition, the bleaching or bleach-fixing solution for use in the present invention can further contain a re-halogenating agent such as bromides (e.g., potassium bromide, sodium bromide, ammonium bromide), chlorides (e.g., potassium chloride, sodium chloride, ammonium chloride) or iodides (e.g., ammonium iodide). Also, the solutions can additionally contain one or more inorganic acids, organic acids or alkali metal or ammonium salts thereof having a pH buffering capacity, such as boric acid, borax, sodium metaborate, acetic acid, sodium acetate, sodium carbonate, potassium carbonate, phosphorus acid, phosphoric acid, sodium phosphate, citric acid, sodium citrate or tartaric acid, as well as an anti-corrosive agent such as ammonium nitrate or guanidine, if desired.

The fixing agent to be used in the bleach-fixing solution or fixing solution for use in the present invention may be a known fixing agent which is a water-soluble silver halide-dissolving agent, such as thiosulfates (e.g., sodium thiosulfate, ammonium thiosulfate); thiocyanates (e.g., sodium thiocyanate, ammonium thiocyanate); or thioether compounds and thiourea compounds (e.g., ethylene-bisthioglycolic acid, 3,6-dithia-1,8 octane-diol). They can be used singly or in the form of a mixture of two or more of them. In addition, a special bleach fixing solution comprising the combination of a fixing agent and a large amount of a halide such as potassium iodide, as described in JP-A-55-155354, may also be used in the present invention. In the practice of the present invention, the use of thiosulfates, especially ammonium thiosulfate, is preferred. The amount of fixing agent in the solution is preferably from 0.3 to 2 mols, more preferably from 0.5 to 1.0 mol, per liter of the solution. The pH range of the bleach-fixing solution or fixing solution is preferably from 3 to 10, more preferably from 5 to 9.

The bleach-fixing solution may further contain other various kinds of brightening agents, defoaming agents and surfactants as well as organic solvents such as polyvinyl pyrrolidone and methanol.

The bleach-fixing solution or fixing solution for use in the present invention can contain, as a preservative, a sulfite ion-releasing compound, such as sulfites (e.g., sodium sulfite, potassium sulfite, ammonium sulfite), bisulfites (e.g., ammonium bisulfite, sodium bisulfite, potassium bisulfite) or metabisulfites (e.g., potassium metabisulfite, sodium metabisulfite, ammonium metabisulfite). The sulfite ion-releasing compound can be incorporated into the solution in an amount of from about 0.02 to about 0.50 mol/liter, more preferably from 0.04 to 0.40 mol/liter, as the sulfite ion.

As a preservative, the addition of sulfite is employed in general, but other preservatives such as ascorbic acids, carbonyl-bisulfite adducts or carbonyl compounds can also be added.

In addition, a buffer, a brightening agent, a chelating agent, a defoaming agent and a fungicide can also be added to the solution, if desired.

Rinsing in Water and/or Stabilization

The silver halide color photographic material which is processed by the method of the present invention is generally rinsed in water and/or stabilized, after the desilvering process such as fixation or bleach-fixation.

The amount of the water to be used in the rinsing step can be set in a broad range, in accordance with the characteristics of the photographic material which is being processed (for example, depending upon the raw material components, such as coupler) or the use of the material, as well as the temperature of the rinsing water, the number of the rinsing tanks (the number of the rinsing stages), the replenishment system of normal current or countercurrent and other conditions. Among the conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955). In general, the number of the stages in the multi-stage countercurrent rinsing system is preferably from 2 to 6, especially from 2 to 4.

According to the multi-stage countercurrent system, the amount of the rinsing water to be used can be reduced noticeably, and for example, it may be from 0.5 liter to one liter or less per $m^2$ of the photographic material which is being processed. Therefore, the effect of the present invention is remarkable in such a system. However, because of the prolongation of the residence time of the water in the rinsing tank, bacteria would propagate in the tank so that the suspended matters generated by the propagation of bacteria would adhere to the surface of the material which is being processed. Accordingly, the system would often have a problem. In the practice of the present invention for processing color photographic materials, the method of reducing calcium and magnesium, which is described in JP-A-62-288838, can extremely effectively be used for overcoming this problem. In addition, the isothiazolone compounds and thiabendazoles described in JP-A-57-8542; chlorine-containing bactericides such as the chlorinated sodium isocyanurates described in JP-A-61-120145; the benzotriazoles described in JP-A-61-267761; copper ion; and other bactericides or fungicides described in H. Horiguchi, *Chemistry of Bactericidal and Fungicidal Agents* (1982), *Bactericidal and Fungicidal Techniques for Microorganisms,* edited by Association of Sanitary Technique, Japan, and *Encyclopedia of Bactericidal and Fungicidal Agents* (1986), edited by Nippon Bactericide and Fungicide Association can also be used.

In addition, a surfactant, as a water-cutting agent, as well as a chelating agent such as EDTA, as a water softener, can also be added to the rinsing water.

Following the rinsing step, the material can be processed with a stabilizing solution, or alternatively, the material can directly be processed with a stabilizing solution without the rinsing step. To the stabilizing solution can be added a compound having an image stabilizing function. For example, aldehyde compounds such as formalin, buffers for adjusting to the film pH value suitable for image stabilization as well as ammonium compounds can be added to the stabilizing solution. In addition, the above-mentioned various kinds of bactericides and fungicides can also be added to the stabilizing solution so as to prevent the propagation of bacteria in the solution or to impart a fungicidal capacity to the photographic material which is being processed.

Further, a surfactant, a brightening agent and a hardener can also be added to the stabilizing solution. In the practice of the present invention, when the stabilization step is directly carried out without the water-rinsing step, any and every known method, for example, the methods described in JP-A-57-8543, JP-A-58-14834 and JP-A-60-220345 can be utilized.

In addition, a chelating agent such as 1-hydroxy ethylidene-1,1-diphosphonic acid or ethylenediaminetetramethylenephosphonic acid, as well as a magnesium or bismuth compound can also be used as a preferred embodiment.

A so-called conventional rinsing solution can also be used in place of the water-rinsing solution or the stabilizing solution, and the former may be utilized after the desilvering step in the same manner as the later.

In the rinsing step or stabilization step of the present invention, the pH value of the solution is from 4 to 10, preferably from 5 to 8. The temperature of the solution can be set variously in accordance with the characteristic and the use of the photographic material which is being processed, and, in general, it is from 14° to 45° C., preferably from 20° to 40° C. The processing time in the step may also be set variously, but the time is preferably as short as possible as the effect of the present invention can be attained more remarkably. Concretely, it is preferably from 30 seconds to 4 minutes, more preferably from 30 seconds to 2 minutes. The amount of the replenisher which can be used in the processing method of the present invention is preferably as small as possible, in view of the economized running cost, the reduced drainage and the easy handlability of the process, and the effect of the present invention is more remarkable under such a condition of using a reduced amount of replenisher.

Concretely, the preferred amount of the replenisher is from 0.5 to 50 times, especially preferably from 3 to 40 times, of the amount of the carry-over from the previous bath per unit area of the photographic material being processed. That is, the amount is one liter or less, preferably 500 ml or less, per $m^2$ of the photographic material being processed. The replenishment may be carried out either continuously or intermittently.

The solution which is used in the water-rinsing and/or stabilization step(s) can be used again in a previous step. As an example, there may be mentioned a process in which the overflow of the rinsing water, which has been reduced in the multi-stage countercurrent system, is returned backward to the previous bleach-fixing bath and a fresh concentrated solution is replenished into the bleach-fixing bath so as to decrease the amount of the resulting waste drainage.

The method of the present invention can be applied to any and every photographic processing which uses a color developer. For example, the method of the present invention can be applied to the photographic processing of color papers, color reversal papers, color direct positive photographic materials, color positive films, color negative films and color reversal films, and in particular, it is especially preferably applied to the photographic processing of color papers and color reversal papers.

Next, silver halide color photographic materials which are processed by the method of the present invention will be explained in detail hereunder.

Various color couplers can be incorporated into the photographic materials to be processed by the method of the present invention. The color coupler herein referred to means a compound capable of forming a dye by a coupling reaction with the oxidation product of an aromatic primary amine developing agent. Specific examples of usable color couplers include naphthol or phenol compounds, pyrazolone or pyrazoloazole compounds and open-chain or heterocyclic ketomethylene compounds. Examples of the cyan, magenta and yellow couplers which can be used in the present invention are described in the patent publications as referred to in *Research Disclosure* Item 17643 (December, 1978), VII-D and ibid., Item 18717 (November, 1979).

It is preferred that the couplers which are incorporated into the color photographic materials which are processed by the method of the present invention are nondiffusible due to having a ballast group or being polymerized. 2-Equivalent color couplers in which the coupling active position has been substituted by a releasable group are preferred for use in the present invention to 4-equivalent color couplers in which a hydrogen atom is in the coupling active position, because the amount of the silver which is coated on the photographic material may be reduced and the effect of the present invention can be attained more noticeably. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

As yellow couplers for use in the present invention, oil protect type acylacetamide couplers are typical examples. Specific examples of these couplers are described in U.S. Pat. Nos. 2,407,210, 2,875,057 and 3,265,506. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501 and 4,022,620, and the nitrogen atom-releasing type yellow couplers described in JP-B 58-10739, U.S. Pat. Nos. 4,401,752, 4,326,024, *Research Disclosure,* Item 18053 (April, 1979), British Patent No. 1,425,020, West German Patent Application (OLS) Nos. 2,219,917, 2,261,361, 2,329,587 and 2,433,812. Of the yellow couplers, α-pivaloylacetanilide couplers are excellent in fastness, in particular, light fastness of the colored dyes formed, while α-benzoylacetanilide couplers are excellent in color density.

As magenta couplers for use in the present invention, there are oil protect type indazolone or cyanoacetyl couplers, and preferably 5-pyrazolone magenta couplers and other pyrazoloazole couplers such as pyrazolotriazoles. As the 5-pyrazolone couplers, those substituted by an arylamino group or an acylamino group at the 3 position thereof are preferred from the viewpoint of the hue and coloring density of the colored dyes formed. Specific examples of these couplers ar described in U.S. Pat. Nos. 2,311,082, 2,343,703, 2,600,788, 2,908,573, 3,062,653, 3,152,896 and 3,936,015. As the releasable groups for the 2-equivalent 5-pyrazolone couplers, the nitrogen atom-releasing groups described in U.S. Pat. No. 4,310,619 and the arylthio groups described in U.S. Pat. No. 4,351,897 are preferred. Furthermore, the 5-pyrazolone magenta couplers having a ballast group described in European Patent No. 73,636 give high color density.

As the pyrazoloazole couplers, there may be mentioned the pyrazolobenzimidazoles described in U.S. Pat. No. 3,369,879, preferably the pyrazolo[5,1-c][1,2,4]-triazoles described in U.S. Pat. No. 3,725,067, the pyrazolotetrazoles described in *Research Disclosure,* Item 24220 (June, 1984), and the pyrazolopyrazoles described in *Research Disclosure,* Item 24230 (June, 1984). The imidazo[1,2-b]pyrazoles described in European Patent No. 119,741 are preferred because of the small subsidiary absorption of the colored dyes and of the sufficient light-fastness thereof, and in particular, the pyrazolo[1,5-b][1,2,4 triazoles described in European Patent No. 119,860 are especially preferred.

As cyan couplers for use in the present invention, there are oil protect type naphthol or phenol couplers. Specific examples of the naphthol couplers include the cyan couplers described in U.S. Pat. No. 2,474,293 and preferably the oxygen atom-releasing type 2-equivalent naphthol couplers described in U.S. Pat. Nos. 4,052,212, 4,146,396, 4,228,233 and 4,296,200. Also, specific examples of the phenol cyan couplers are described in U.S. Pat. Nos. 2,369,929, 2,801,171, 2,772,162 and 2,895,826. Cyan couplers having high fastness to humidity and temperature are preferably used in the present invention and specific examples of these cyan couplers include the phenol cyan couplers having an alkyl group of 2 or more carbon atoms at the metaposition of the phenol nucleus described in U.S. Pat. No. 3,772,002; the 2,5-diacylamino-substituted phenol cyan couplers described in U.S. Pat. Nos. 2,772,162, 3,758,308, 4,126,396, 4,334,011, 4,327,173, West German Patent Application (OLS) No. 3,329,729 and JP-A-59-166956; and the phenol couplers having a phenylureido group at the 2-position thereof and an acylamino group at the 5-position thereof described in U.S. Pat. Nos. 3,446,622, 4,333,999, 4,451,559 and 4,427,767.

In accordance with the present invention, cyan couplers as represented by the following general formula (C-I) are preferably used for the purpose of preventing stain in the processed photographic material and of reducing the change in the characteristics of the processing liquid used in continuous processing.

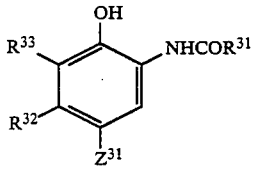

(C-I)

where $R^{31}$ represents an alkyl group, a cycloalkyl group, an aryl group, an amino group or a heterocyclic group;

$R^{32}$ represents an acylamino group or an alkyl group having 2 or more carbon atoms;

$R^{33}$ represents a hydrogen atom, a halogen atom, an alkyl group or an alkoxy group, or $R^{33}$ may be bonded to $R^{32}$ to form a ring; $Z^{31}$ represents a hydrogen atom, a halogen atom or a group capable of being released by reaction with the oxidation product of an aromatic primary amine color developing agent.

The formula (C-1) will be explained in detail hereunder.

The alkyl group for R31 is preferably one having from 1 to 32 carbon atoms, such as methyl, butyl, tridecyl, cyclohexyl or allyl group. The aryl group for $R^{31}$ includes, for example, phenyl or naphthyl group. The heterocyclic group for R3I includes, for example, 2-pyridyl or 2-furyl group.

When $R^{31}$ represents an amino group, it is especially preferably a phenyl-substituted amino group which may optionally have substituent(s).

$R^{31}$ may be substituted by substituent(s) selected from an alkyl group, an aryl group, an alkyloxy or aryloxy, group (e.g., methoxy, dodecyloxy, methoxyethoxy, phenyloxy, 2,4-di-tert-amylphenoxy, 3-tert-butyl-4-hydroxyphenyloxy, naphthyloxy), a carboxyl group, an alkylcarbonyl or arylcarbonyl group (e.g., acetyl, tetradecanoyl, benzoyl), an alkyloxycarbonyl or aryloxycarbonyl group (e.g., methoxycarbonyl, phenoxycarbonyl), an acyloxy group (e.g., acetyl, benzoyloxy), a sulfamoyl group (e.g., N-ethylsulfamoyl, N-octadecylsulfamoyl), a carbamoyl group (e.g., N-ethylcarbamoyl, N-methyl-dodecylcarbamoyl), a sulfonamido group (e.g., methanesulfonamido, benzenesulfonamido), an acylamino group e.g., acetylamino, benzamido, ethoxycarbonylamino, phenylaminocarbonylamino), an imido group (e.g., succinimido, hydantoinyl), a sulfonyl group (e.g., methanesulfonyl), a hydroxyl group, a cyano group, a nitro group and a halogen atom.

In the formula C-I), $Z^{31}$ represents a hydrogen atom or a coupling-releasing group. Examples of the coupling-releasing group include a halogen atom (e.g., fluorine, chlorine, bromine), an alkoxy group (e.g., dodecyloxy, methoxycarbamoylmethoxy, carboxypropyloxy, methylsulfonylethoxy), an aryloxy (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., phenylthio, tetrazolylthio), an imido group (e.g., succinimido, hydantoinyl), an N-heterocyclic group (e.g., 1-pyrazolyl, 1-benzotriazolyl) and an aromatic azo group (e.g., phenylazo group). These releasing groups may optionally have a photographically useful group.

The formula (C-I) may form a dimer or a higher polymer at the position of $R^{31}$ or $R^{32}$.

Specific examples of the cyan coupler represented by the aforesaid formula (C-I) are given below, which, however, are not intended to restrict the scope of the present invention.

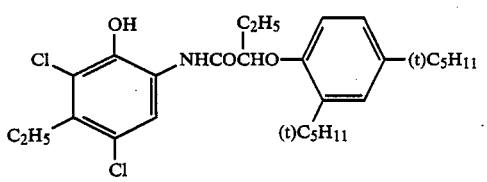

(C-1)

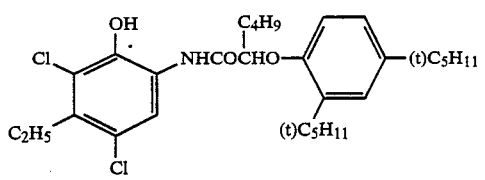

(C-2)

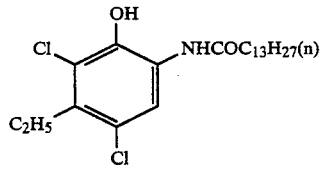

(C-3)

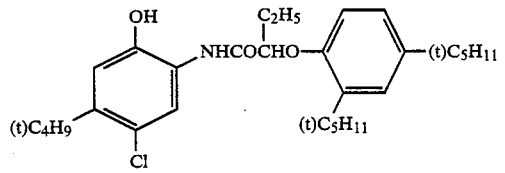

(C-4)

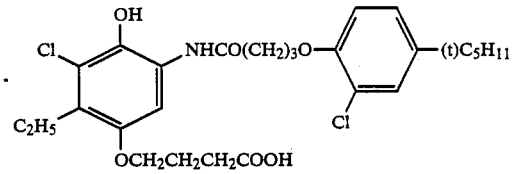

(C-5)

-continued
(C-6)
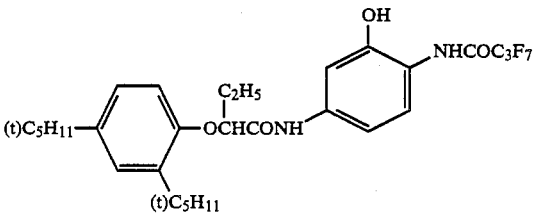
(C-7)
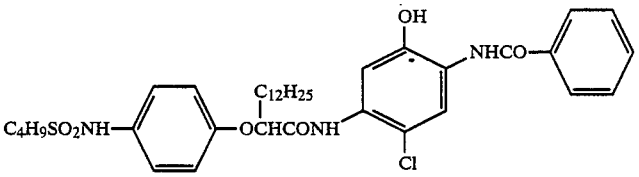
(C-8)
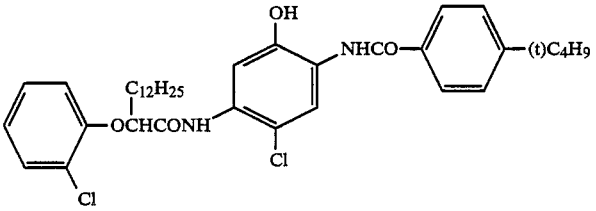
(C-9)
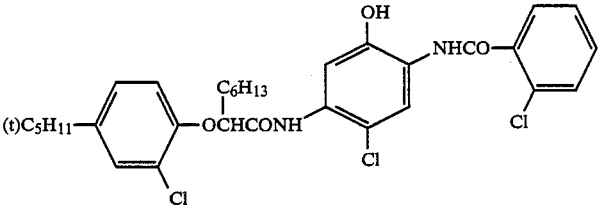
(C-10)
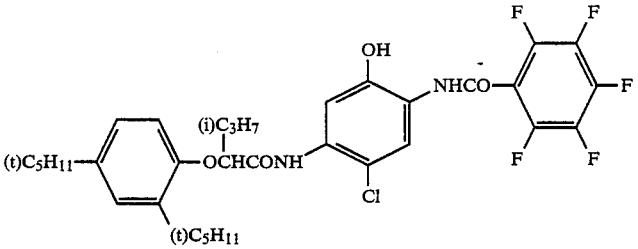
(C-11)
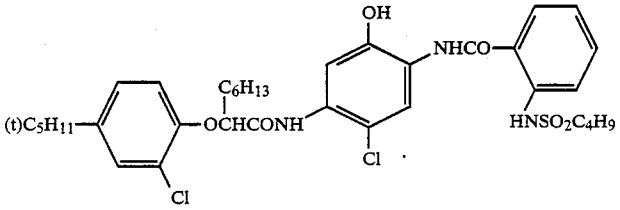
(C-12)
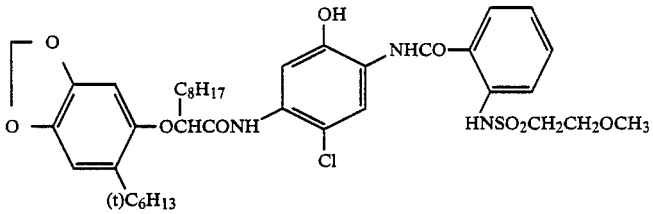

-continued
(C-13)
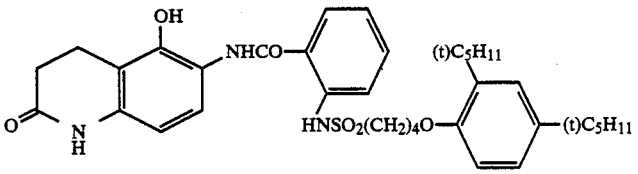
(C-14)
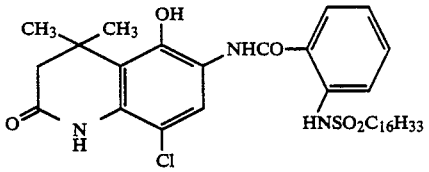
(C-15)
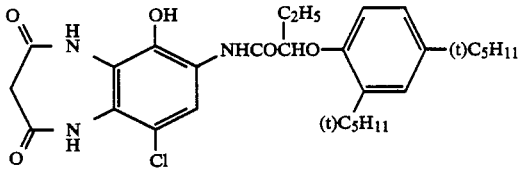
(C-16)
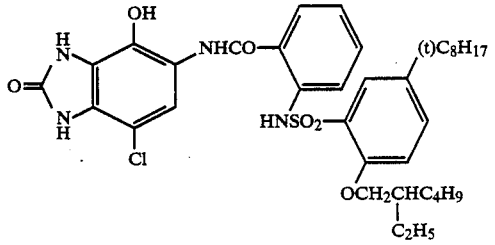
(C-17)
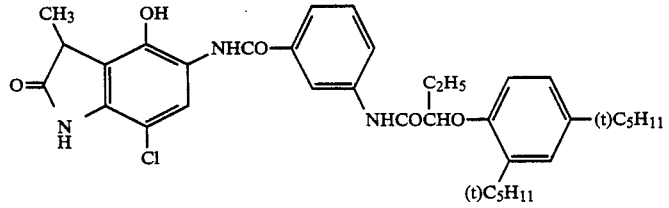
(C-18)
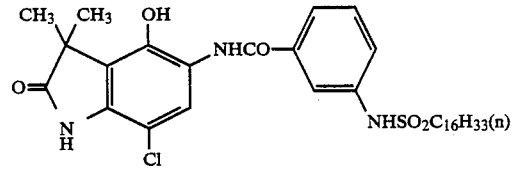
(C-19)
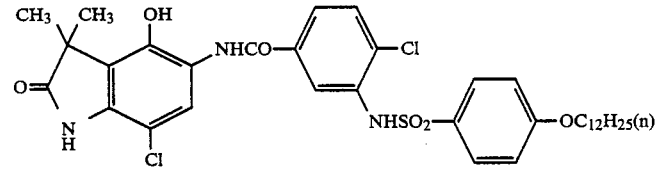
(C-20)
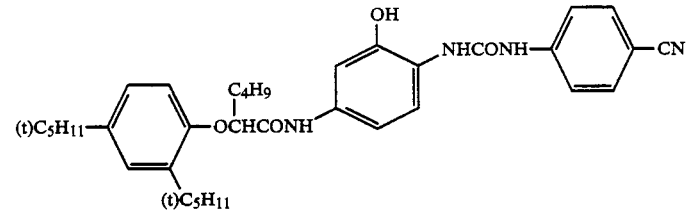

-continued
(C-21)
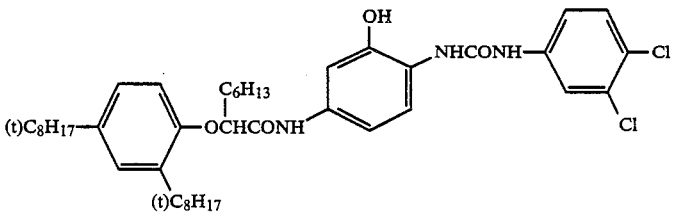
(C-22)
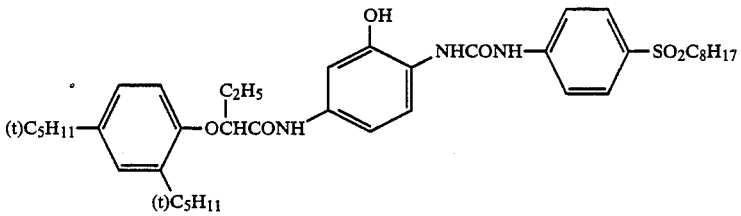
(C-23)
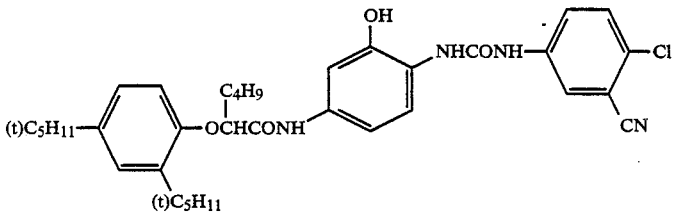
(C-24)
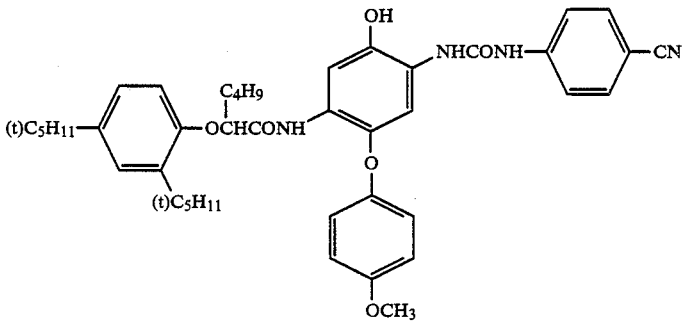
(C-25)
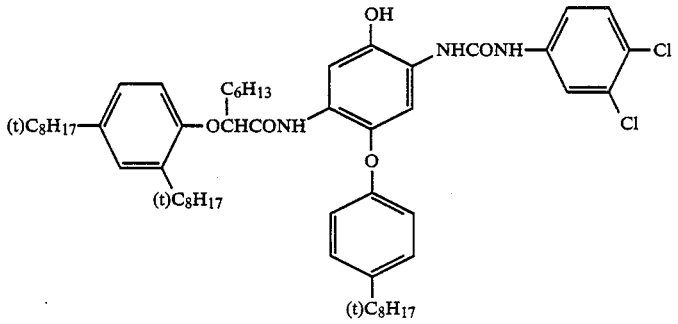
(C-26)
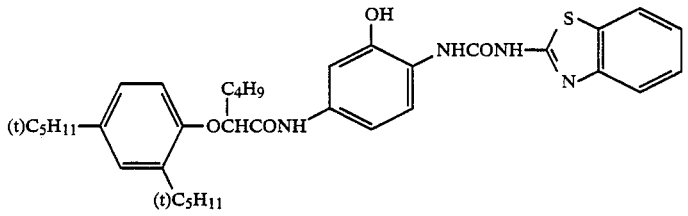

The cyan couplers of the formula (C-I) can be produced in accordance with the disclosure in JP-A-59-166956 and JP-B-49-11572.

In the present invention, 4-equivalent couplers may also be used, if desired, or couplers giving colored dyes having a proper diffusibility ma also be used together with the aforesaid couplers to improve the graininess of the color images formed. As specific examples of such couplers giving diffusible dyes, magenta couplers of the type are described in U.S. Pat. No. 4,366,237 and British Patent No. 2,125,570; and yellow, magenta nd cyan couplers of the type are described in European Patent No. 96,570 and West German Patent Application (OLS) No. 3,234,533.

The dye-forming couplers and the above-mentioned particular couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Patent No. 2,102,173 and U.S. Pat. No. 4,367 282.

The various Kinds of couplers for use in the present invention may be used for the same photographic layer of a color photographic material as a combination of two or more kinds thereof for meeting particular characteristics required for the color photographic material, or the same kind of coupler may be used for two or more photographic layers for meeting the required characteristics.

The standard amount of the color coupler to be incorporated is in the range of from 0.001 to one mol per mol of the light-sensitive silver halide in the silver halide emulsion and the preferred amount is from 0.01 to 0.5 mol for yellow coupler, from 0.003 to 0.3 mol for magenta coupler and from 0.002 to 0.3 mol for cyan coupler.

The couplers for use in the present invention can be incorporated into the photographic materials by means of various known dispersion methods. For instance, an oil in-water dispersion method can be mentioned as one example, and examples of high boiling point organic solvents which can be used in the oil-in-water dispersion method are described in U.S. Pat. No. 2,322,027. Another example is a latex dispersion method, and the procedure and effect of the method and examples of latexes to be used for impregnation are described in U.S. Pat. No. 4,199,363, West German Patent Application (OLS) Nos. 2,541,274 and 2,541,230.

The silver halide emulsions in the photographic materials to be processed by the method of the present invention may have any halogen composition, for example, silver iodobromide, silver bromide, silver chlorobromide or silver chloride. For example, in the case of rapid processing or processing with low replenishment for color papers, a silver chlorobromide emulsion containing silver chloride in an amount of 60 mol % or more or a silver chloride emulsion is preferred, and in particular, the emulsion having a silver chloride content of from 80 to 100 mol % is most preferred. If a high sensitivity is sepcifically required, and the fog is required to be specifically lowered during manufacture, storage and/or the processing procedure of the photographic material, a silver chlorobromide emulsion containing silver bromide in an amount of 50 mol % or more or a silver bromide emulsion (which may contain 3 mol % or less silver iodide) is preferred, and in particular, the silver bromide content in the emulsion is more preferably 70 mol % or more. For picture-taking color photographic materials, a silver iodobromide and a silver chloroiodobromide are preferred, in which the silver iodide content is preferably from 3 to 15 mol %.

The silver halide grains for use in the present invention may differ in composition or phase between the inside and the surface layer thereof, or may have a multiphase structure having a junction structure or may have a uniform phase or a mixture thereof throughout the whole grain. Also the silver halide grains may be composed of a mixture of these grains having different phase structures.

The mean grain size distribution of the silver halide grains for use in the present invention may be narrow or broad, but a so-called monodispersed silver halide emulsion wherein the value (variation) obtained by dividing the standard deviation in the grain size distribution curve of the silver halide emulsion by the mean grain size is within about 20%, and preferably within 15%, is preferably used in the present invention. Also, for satisfying the gradation required for the color photographic material, two or more kinds of monodispersed silver halide emulsions (preferably having the above-mentioned variation as the monodispersibility) can exist in one emulsion layer having substantially the same color sensitivity as a mixture thereof or exist in two or more emulsion layers, separately, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, separately.

The silver halide grains for use in the present invention may have a regular crystal form such as cubic, octahedral, rhombic dodecahedral or tetradecahedral crystal form or a combination thereof, or an irregular crystal form such as a spherical crystal form, or further a composite form of these crystal forms. Also, a tabular grain silver halide emulsion can be used in the present invention. In particular, a tabular grain silver halide emulsion wherein tabular silver halide grains having an aspect ratio (length/thickness) of from 5 to 8 or more than 8 account for 50% or more of the total projected area of the silver halide grains may be used. The silver halide emulsion for use in the present invention may be a mixture of these emulsions containing silver halide grains each having different crystal forms.

Also, the silver halide grains may be of a surface latent image type capable of forming latent images mainly on the surface thereof or of an internal latent image type capable of forming latent images mainly in the inside thereof.

The photographic emulsions for use in the present invention can be prepared by the method described in *Research Disclosure,* Vol. 170, Item 17643, I. II, III (December, 1978).

The photographic emulsions are generally subjected to physical ripening, chemical ripening and spectral sensitization, for use in the present invention. The additives to be used in the steps of ripening and sensitization are described in *Research Disclosure,* Vol. 176, Item 17643 (December, 1979) and ibid., Vol. 187, Item 18716 (November, 1979), and the relevant portions are summarized in the following Table.

Known photographic additives which can be used in the present invention are also described in the above two *Research Disclosure's,* and the relevant portions are also mentioned in the following Table.

| Additives | RD 17643 | RD 18716 |
|---|---|---|
| 1. Chemical Sensitizer | Page 23 | Page 648, right column |
| 2. Sensitivity Enhancing Agent | | Page 648, right column |
| 3. Spectral Sensitizer | Pages 23 to 24 649, right column | Page 648, right column to page |
| 4. Supersensitizer | | Page 648, right column to page 649, right column |
| 5. Brightening Agent | Page 24 | |
| 6. Antifoggant Stabilizer | Pages 24 to 25 | Page 649, right column |
| 7. Coupler | Page 25 | |
| 8. Organic Solvent | Page 25 | |
| 9. Light Absorber Filter Dye | Pages 25 to 26 | Page 649, right column to page 650, left column |
| 10. UV Absorber | | |
| 11. Stain Inhibitor | Page 25, right column | Page 650, from left to right columns |
| 12. Color Image Stabilizer | Page 25 | |
| 13. Hardener | Page 26 | Page 651, left column |
| 14. Binder | Page 26 | Page 651, left column |
| 15. Plasticizer, Lubricant | Page 27 right column | Page 650, |
| 16. Coating Assistant, Surfactant | Pages 26 to 27 | Page 650, right column |
| 17. Antistatic Agent | Page 27 | Page 650, right column |

The photographic light-sensitive material for use in the present invention can be coated on a conventional flexible support such as plastic films (e.g., cellulose nitrate, cellulose acetate, polyethylene terephthalate) or paper, or a conventional rigid support such as glass. The details of the supports and the coating means are described in *Research Disclosure,* Vol. 176, Item 17643, XV (page 27) and XVII (page 28) (December, 1978).

In the present invention,a reflective support is preferably used.

The "reflective support" has a high reflectivity for clearly viewing the dye images formed in silver halide emulsion layers of the color photographic material, and this includes a support coated with a hydrophobic resin having dispersed therein a light-reflective material such as titanium oxide, zinc oxide, calcium carbonate or calcium sulfate, and a support comprised of a hydrophobic resin having dispersed therein a light-reflective material as described above.

The following examples are intended to illustrate the present invention but not to limit it in any way.

EXAMPLE 1

A multilayer color photographic paper was prepared by forming the layers having the compositions shown below on a paper support both surfaces of which were coated with polyethylene. The coating compositions for the layers were prepared as follows.

Coating Composition for First Layer 27.2 cc of ethyl acetate and 7.7 cc (8.0 g) of High Boiling Point Solvent (Solv-1) were added to 10.2 g of Yellow Coupler (ExY-1), 9.1 g of Yellow Coupler (ExY2) and 4.4 g of Color Image Stabilizer (Cpd-1) and dissolved, and the resulting solution was dispersed by emulsification in 185 cc of an aqueous 10 wt % gelatin solution containing 8 cc of a 10 wt % sodium dodecylbenzenesulfonate solution. The emulsified dispersion and Emulsion (EM1) and Emulsion (EM2) were blended and dissolved and the gelatin concentration was adjusted as shown below to provide the coating composition for the first layer. Coating compositions for the second layer to the seventh layer were also prepared by the same manner as in the first layer. As a gelatin hardening agent for each layer, 1-hydroxy-3,5-dichloro-s-triazine sodium salt was used. Compound (Cpd-2) was used as a thickening agent.

The layer constitution was as follows. The number after each ingredient means the amount coated (g/m$^2$). The amount of the silver halide emulsion coated means the amount of silver therein.

Support

Polyethylene-coated Paper, containing a white pigment ($TiO_2$) and a bluish dye in the polyethylene coating which is in contact with the first layer.

First Layer: Blue-sensitive Emulsion Layer

| | |
|---|---|
| Monodispersed Silver Chlorobromide Emulsion (EM1) (spectrally sensitized with Sensitizing Dye (ExS-1)) | 0.13 |
| Monodispersed Silver Chlorobromide Emulsion (EM2) (spectrally sensitized with Sensitizing Dye (ExS-1)) | 0.13 |
| Gelatin | 1.86 |
| Yellow Coupler (ExY-1) | 0.44 |
| Yellow Coupler (ExY-2) | 0.39 |
| Color Image Stabilizer (Cpd-1) | 0.19 |
| Solvent (Solv-1) | 0.35 |

Second Layer: Color Mixing Preventing Layer

| | |
|---|---|
| Gelatin | 0.99 |
| Color Mixing Preventing Agent (Cpd-3) | 0.08 |

Third Layer: Green-sensitive Emulsion Layer

| | |
|---|---|
| Monodispersed Silver Chlorobromide Emulsion (EM3) (spectrally sensitized with Sensitizing Dyes (ExS-2, 3)) | 0.05 |
| Monodispersed Silver Chlorobromide Emulsion (EM4) (spectrally sensitized with Sensitizing Dyes (ExS-2, 3)) | 0.11 |
| Gelatin | 1.80 |
| Magenta Coupler (ExM-1) | 0.39 |
| Color Image Stabilizer (Cpd-4) | 0.20 |
| Color Image Stabilizer (Cpd-5) | 0.02 |
| Color Image Stabilizer (Cpd-6) | 0.03 |
| Solvent (Solv-2) | 0.12 |
| Solvent (Solv-3) | 0.25 |

Fourth Layer: Ultraviolet Absorbing Layer

| | |
|---|---|
| Gelatin | 1.60 |
| Ultraviolet Absorber (Cpd-7/Cpd-8/Cpd-9 = 3/2/6, by weight) | 0.70 |
| Color Mixing Preventing Agent (Cpd-l0) | 0.05 |
| Solvent (Solv-4) | 0.27 |

Fifth Layer: Red-sensitive Emulsion Layer

| | |
|---|---|
| Monodispersed Silver Chlorobromide | 0.07 |

-continued

| | |
|---|---|
| Emulsion (EM5) (spectrally sensitized with Sensitizing Dyes (ExS-4, 5)) | |
| Monodispersed Silver Chlorobromide | 0.16 |
| Emulsion (EM6) (spectrally sensitized with Sensitizing Dyes (ExS-4, 5)) | |
| Gelatin | 0.92 |
| Cyan Coupler (ExC-1) | 0.32 |
| Color Image Stabilizer (Cpd-8/Cpd-9/Cpd-12 = 3/4/2, by weight) | 0.17 |
| Dispersing Polymer (Cpd-11) | 0.28 |
| Solvent (Solv-2) | 0.20 |

Sixth Layer: Ultraviolet Absorbing Layer

| | |
|---|---|
| Gelatin | 0.54 |
| Ultraviolet Absorber (Cpd-7/Cpd-9/Cpd-12 = 1/5/3, by weight) | 0.21 |
| Solvent (Solv-2) | 0.08 |

Seventh Layer: Protective Layer

| | |
|---|---|
| Gelatin | 1.33 |
| Acryl-modified Polyvinyl Alcohol-Copolymer (modification degree 17%) | 0.17 |

-continued

| | |
|---|---|
| Liquid Paraffin | 0.03 |

As an anti-irradiation dye were used Compounds Cpd-13 (20 mg/m$^2$ in Fourth Layer) and Cpd-14 (5 mg/m$^2$ in Second Layer).

In addition, Alkanol XC (by DuPont), sodium alkylbenzenesulfonate, succinic acid ester and Magefacx F-120 (by Dai-Nippon Ink & Chemicals) were used as an emulsification and dispersing agent and a coating assistant agent in each layer. As a stabilizer for silver halides were used Compounds Cpd-15 (0.001-0.005 mol/Agmol in each silver halide emulsion layer) and Cpd-16 (0.001 mol/Agmol in Third Layer).

The details of the emulsions used are as follows.

| Emulsion | Grain Size (μm) | Br Content (mol %) | Coefficient of Variation |
|---|---|---|---|
| EM 1 | 1.0 | 80 | 0.08 |
| EM 2 | 0.75 | 80 | 0.07 |
| EM 3 | 0.5 | 83 | 0.09 |
| EM 4 | 0.4 | 83 | 0.10 |
| EM 5 | 0.5 | 73 | 0.09 |
| EM 6 | 0.4 | 73 | 0.10 |

The structural formulae of the compounds used are as follows:

ExY-1

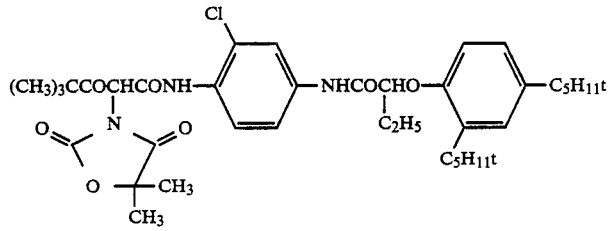

ExY-2

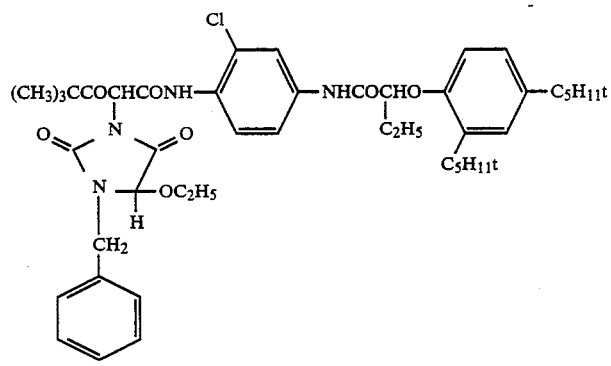

ExM-1

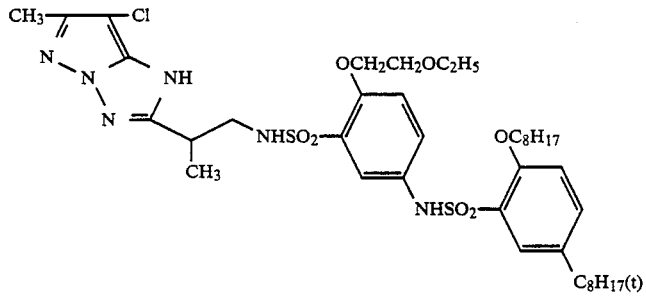

-continued
ExC-1
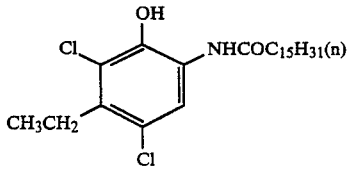
ExS-1
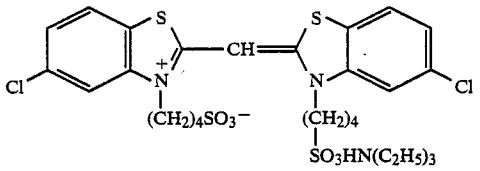
ExS-2
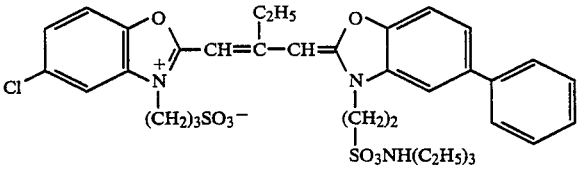
ExS-3
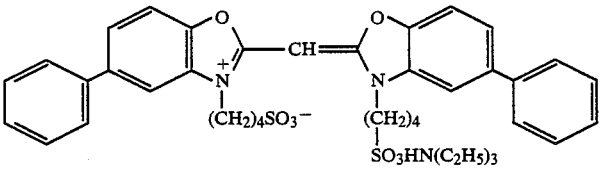
ExS-4
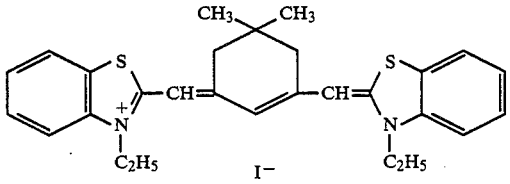
ExS-5
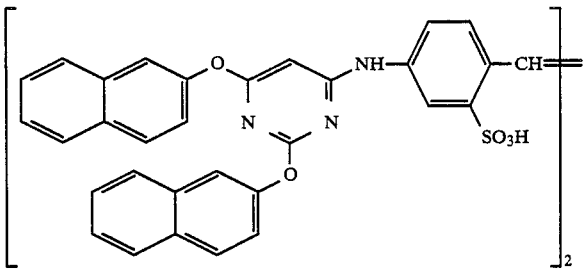
Cpd-1
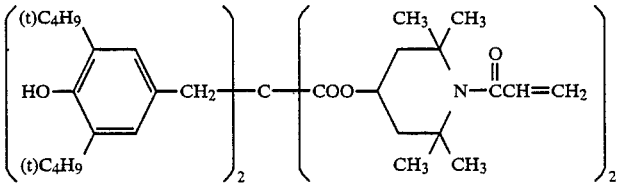
Cpd-2
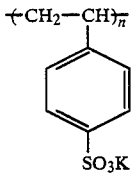

-continued
Cpd-3
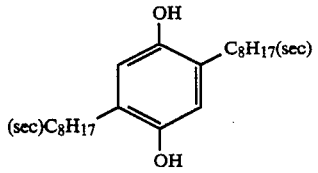
Cpd-4
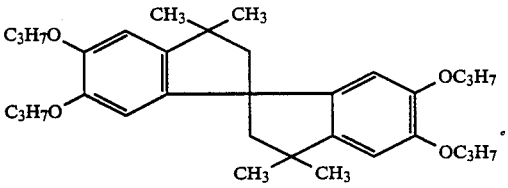
Cpd-5
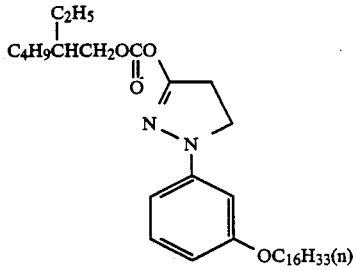
Cpd-6
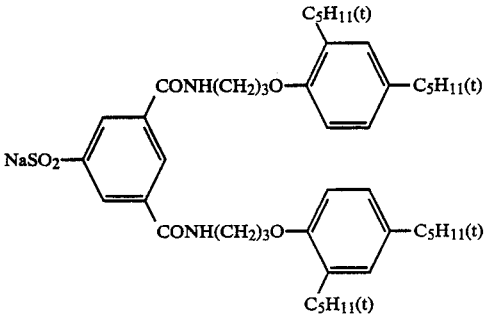
Cpd-7
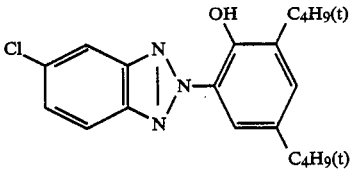
Cpd-8
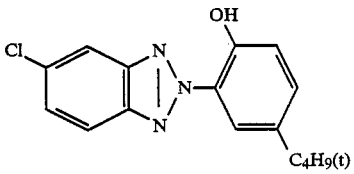
Cpd-9
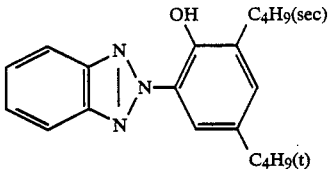

-continued

Cpd-10

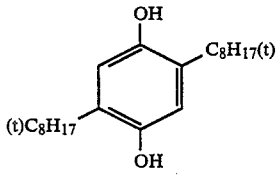

Cpd-11

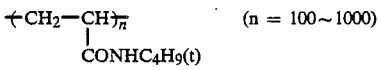

Cpd-12

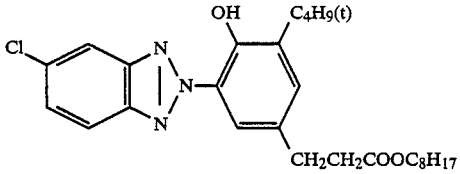

| | |
|---|---|
| Dibutyl Phthalate | Solv-1 |
| Dicresyl Phosphate | Solv-2 |
| Trioctyl Phosphate | Solv-3 |
| Trinonyl Phosphate | Solv-4 |

Cpd-13

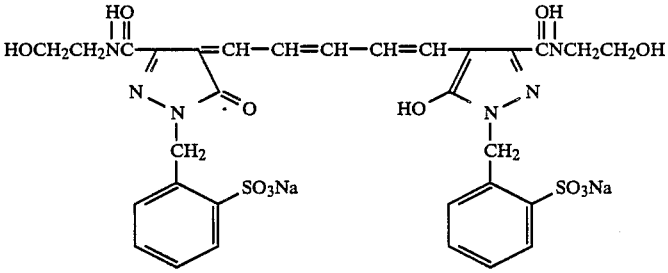

Cpd-14

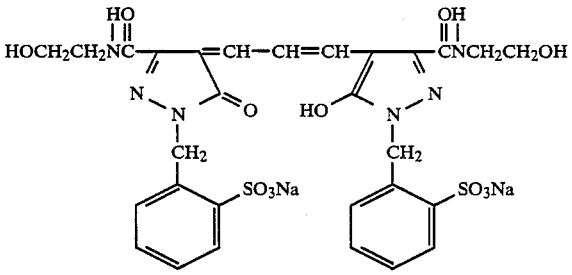

Cpd-15

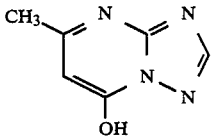

Cpd-16

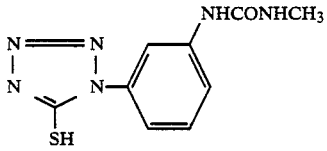

The color photographic paper thus prepared was processed in accordance with the procedure described below. The compositions of the processing solutions used in each step are also mentioned hereunder.

| Processing Step | Temperature | Time |
|---|---|---|
| Color Development | 38° C. | 1 min 40 sec |
| Bleach-fixation | 33° C. | 60 sec |
| Rinsing (1) | 33° C. | 15 sec |

-continued

| Processing Step | Temperature | Time |
|---|---|---|
| Rinsing (2) | 33° C. | 15 sec |
| Rinsing (3) | 33° C. | 15 sec |
| Drying | 80° C. | 50 sec |

Color Developer

| | |
|---|---|
| Water | 800 ml |
| Ethylenediamine-N,N,N',N'-tetramethylenephosphonic Acid | 3.0 g |
| 1-Hydroxyethylidene-1,1 diphosphonic Acid | 2.0 g |
| Potassium Bromide | 0.5 g |
| Potassium Carbonate | 30 g |
| Brightening Agent (WHITEX4 by Sumitomo Chemical) | 1.5 g |
| Compound (I) | See Table 1 |
| Compound (II) | See Table 1 |
| N-ethyl-N-(β-methanesulfonamidoethyl)-3-methyl-4-aminoaniline Sulfate | 5.5 g |
| Triethanolamine | 8.1 g |
| Water to make | 1000 ml |
| pH (25° C.) | 10.25 |

Bleach-fixing Solution

| | |
|---|---|
| Water | 400 ml |
| Ammonium Thiosulfate (70 wt %) | 200 ml |
| Sodium Sulfite | 20 g |
| Ethylenediaminetetraacetic Acid/Iron(III) Ammonium Complex | 60 g |
| Ethylenediaminetetraacetic Acid Disodium Salt | 5 g |
| Water to make | 1000 ml |
| pH (25° C.) | 6.70 |

Rinsing Water

Ion-exchanged Water (calcium and magnesium contents each was 3 ppm or less.)

The color developer having the above-mentioned composition was placed in a beaker and stored at room temperature for 20 days.

The color developer just after preparation is called "fresh color developer" and the color deveoper after being stored as above is called "stored color developer".

The color photographic material prepared as mentioned above was exposed through an optical wedge and then processed with each of the fresh color developer and the stored color developer. The change ($\Delta S_{0.5}$) of the logarithmic value ($S_{0.5}$) of the exposure to give a density (0.5) of yellow, magenta or cyan color between the samples processed with the fresh color developer and the stored color developer was obtained. In addition, the retention (%) of the color developing agent which remains in the stored color developer to that which remains in the fresh color developer was also obtained. The results are shown in Table 1 below.

Table 1 indicates the following facts. Combination of the Compound (II) with conventional hydroxylamine or hydroxamic acid could somewhat improve the processing characteristic of the color developer in some degree, which, however, cannot be said to be sufficient (See Test Nos. 1 and 2; Nos. 3 and 4). As opposed to this, combination of the Compound (I) and the Compound (II) in accordance with the present invention gave extreme improvement, as the value $\Delta S_{0.5}$ was small and the preservability of the developing agent was extremely good.

TABLE 1

| No. | Compound (I) 50 mmol/l | Compound (II) 1 mmol/l | $\Delta S_{0.5}$ R | G | B | Residual Amount of Color Developing Agent (%) | Note |
|---|---|---|---|---|---|---|---|
| 1 | Hydroxylamine | — | −0.10 | −0.12 | −0.13 | 70 | Comparison |
| 2 | " | II-6 | −0.07 | −0.09 | −0.10 | 73 | " |
| 3 | Hydroxamic acid (a) | — | −0.11 | −0.11 | −0.09 | 65 | " |
| 4 | Hydroxamic acid (a) | II-6 | −0.07 | −0.09 | −0.07 | 69 | " |
| 5 | I-7 | — | −0.09 | −0.07 | −0.08 | 80 | " |
| 6 | I-12 | — | −0.09 | −0.07 | −0.08 | 78 | " |
| 7 | I-22 | — | −0.09 | −0.07 | −0.06 | 77 | " |
| 8 | I-7 | II-6 | ±0 | ±0 | −0.01 | 98 | Invention |
| 9 | I-12 | " | ±0 | ±0 | −0.01 | 97 | " |
| 10 | I-22 | " | −0.01 | ±0 | ±0 | 96 | " |
| 11 | I-44 | " | −0.01 | ±0 | ±0 | 96 | " |
| 12 | I-48 | " | ±0 | −0.01 | −0.01 | 98 | " |
| 13 | I-49 | II-6 | ±0 | ±0 | −0.01 | 95 | Invention |
| 14 | I-7 | II-1 | ±0 | ±0 | −0.01 | 93 | " |
| 15 | " | II-2 | −0.01 | −0.01 | −0.01 | 92 | " |
| 16 | " | II-3 | −0.01 | ±0 | −0.01 | 97 | " |
| 17 | " | II-4 | −0.01 | −0.01 | −0.01 | 95 | " |

(a) Hydroxamic acid used is as follows:

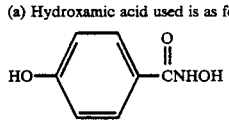

EXAMPLE 2

The same photographic material sample as in Example 1 was prepared.

Next, various kinds of color developers were prepared, whereupon the preservative and the chelating agent were varied as indicated in Table 2 below. Each of the thus prepared developers was circulated in a circulator having an opening ratio (S/V) of 0.02, at 35° C. for 300 hours. The variation in the photographic characteristics of the developer tested between the time of starting and after completion of the circulation was obtained for every test case. The results obtained are shown in Table 2 below.

In the formula S/V, S means the surface area ($cm^2$) of the developer tested, which is in contact with air; and V means the volume ($cm^3$) of the developer tested.

For determination of the change in the photographic characteristics of the color photographic paper sample tested, the sample was wedgewise exposed and then the change in the minimum density ($\Delta D_{Rmin}$), the change in the sensitivity ($\Delta S_R$) and the change in the maximum density ($\Delta D_{Rmax}$) of the cyan density were obtained The change in the sensitivity was represented by the change in the exposure which was necessary for giving a density of 0.6 ($\Delta$log E).

The processing procedure comprised the following step.

| Processing Step | Temperature | Time |
|---|---|---|
| Color Development | 38° C. | 1 min 40 sec |
| Bleach-fixation | 33° C. | 60 sec |
| Rinsing (1) | 30 to 34° C. | 20 sec |
| Rinsing (2) | 30 to 34° C. | 20 sec |
| Rinsing (3) | 30 to 34° C. | 20 sec |
| Drying | 70 to 80° C. | 50 sec |

(The rinsing step was carried out by a three-tank countercurrent rinsing system form a rinsing bath (3) to a rinsing bath (1).)

The processing solutions used in the respective steps were as follows.

Color Developer

| | |
|---|---|
| Water | 800 ml |
| Chelating Agent (see Table 2) | 0.01 mol |
| Preservative (see Table 2) | 0.05 mol |
| Potassium Bromide | 0.5 g |
| Potassium Carbonate | 30 g |
| Sodium Sulfite | 1.7 g |
| N-ethyl-N-($\beta$-Methanesulfonamidoethyl)-3-methyl-4-aminoaniline Sulfate | 5.5 g |
| Brightening Agent (WHITEX4 by Sumitomo Chemical) | 1.5 g |
| Benzyl Alcohol | See Table 2 |
| Diethylene Glycol | 10 ml |
| Water to make | 1000 ml |
| pH | 10.25 |

Bleach-fixing Solution

| | |
|---|---|
| Water | 400 ml |
| Ammonium Thiosulfate (70 wt %) | 200 ml |
| Sodium Sulfite | 20 g |
| Ethylenediaminetetraacetic Acid/Iron(III) Ammonium Complex | 60 g |
| Ethylenediaminetetraacetic Acid Disodium Salt | 5 g |
| Water to make | 1000 ml |
| pH (25° C.) | 6.70 |

Rinsing Water

Ion-exchanged Water (calcium and magnesium contents each was 3 ppm or less.)

The results (change in photographic characteristics) thus obtained are shown in Table 2 below.

As is obvious from Table 2, the change in the photographic characteristics in the storage test of color developers was noticeably reduced in accordance with the present invention, and the effect was extremely remarkable in the color developers free of benzyl alcohol.

TABLE 2

| | Additives | | | | Change in Photographic Characteristics | | |
|---|---|---|---|---|---|---|---|
| No. | Chelating Agent | Preservative | Benzyl Alcohol (ml/l) | Note | $\Delta D_R$min | $\Delta S_R$ | $\Delta D_R$max |
| 1 | Ethylenediaminetetraacetic acid | I-1 | — | Comparison | +0.03 | −0.06 | +0.05 |
| 2 | Hydroxyethyliminodiacetic acid | I-7 | — | " | +0.03 | −0.06 | +0.06 |
| 3 | Diethylenetriaminepenta-acetic acid | I-22 | — | " | +0.03 | −0.05 | +0.06 |
| 4 | Diethylenetriaminepenta-acetic acid | " | 15 | " | +0.04 | −0.06 | +0.05 |
| 5 | (5) | Hydroxylamine sulfate | — | " | +0.05 | −0.10 | +0.13 |
| 6 | (25) | N,N-diethylhydroxyl-amine | — | " | +0.04 | −0.09 | +0.10 |
| 7 | (57) | Hydroxylamine sulfate | — | " | +0.05 | −0.08 | +0.12 |
| 8 | (68) | N,N-diethylhydroxyl-amine | — | " | +0.05 | −0.08 | +0.14 |
| 9 | (68) | N,N-diethylhydroxyl-amine | 15 | " | +0.06 | −0.08 | +0.16 |
| 10 | (1) | I-7 | — | Invention | +0.01 | +0.02 | +0.01 |
| 11 | (5) | " | — | " | +0.01 | +0.02 | +0.01 |
| 12 | (25) | " | — | " | +0.01 | 0 | 0 |
| 13 | (57) | " | — | " | +0.01 | +0.01 | 0 |
| 14 | (68) | " | — | " | 0 | 0 | 0 |
| 15 | (68) | " | 5 | " | +0.02 | +0.02 | +0.02 |
| 16 | (68) | " | 15 | " | +0.02 | +0.02 | +0.03 |
| 17 | (68) + Diethylenetriamine-pentaacetic acid (1:1) | " | — | " | 0 | 0 | +0.01 |
| 18 | (57) + Diethylenetriamine-pentaacetic acid (1:1) | " | — | " | 0 | +0.01 | +0.01 |
| 19 | (3) | I-1 | — | " | +0.01 | −0.02 | +0.02 |
| 20 | (5) | I-12 | — | " | +0.01 | −0.01 | +0.03 |
| 21 | (5) | I-14 | — | " | +0.01 | −0.01 | +0.02 |
| 22 | (67) | I-17 | — | " | 0 | 0 | 0 |
| 23 | (57) | I-17 | — | " | 0 | +0.01 | +0.01 |
| 24 | (25) | I-22 | — | " | 0 | −0.02 | +0.02 |
| 25 | (57) | " | — | " | 0 | −0.01 | −0.02 |
| 26 | (68) | I-22 | — | " | 0 | 0 | −0.01 |
| 27 | (4) | I-34 | — | " | +0.01 | +0.01 | +0.02 |
| 28 | (10) | I-35 | — | " | +0.01 | +0.02 | +0.01 |
| 29 | (17) | I-42 | — | " | +0.01 | +0.02 | +0.02 |
| 30 | (18) | I-44 | — | " | +0.01 | +0.02 | +0.02 |

TABLE 2-continued

| No. | Additives: Chelating Agent | Preservative | Benzyl Alcohol (ml/l) | Note | Change in Photographic Characteristics: $\Delta D_R$min | $\Delta S_R$ | $\Delta D_R$max |
|---|---|---|---|---|---|---|---|
| 31 | (25) | I-49 | — | " | +0.01 | +0.02 | +0.02 |
| 32 | (34) | I-58 | — | " | +0.01 | +0.01 | 0 |
| 33 | (35) | I-65 | — | " | +0.01 | +0.01 | +0.02 |
| 34 | (54) | I-71 | — | " | +0.01 | +0.01 | +0.02 |
| 35 | (57) | I-74 | — | " | +0.01 | +0.02 | +0.02 |
| 36 | (68) | I-86 | — | " | +0.01 | +0.01 | +0.02 |
| 37 | (1) | I-7, II-2 (0.3 g/l) | — | " | 0 | 0 | 0 |
| 38 | (1) | I-7, II-6 (0.3 g/l) | — | " | 0 | 0 | 0 |

EXAMPLE 3

The multilayer color photographic paper prepared in Example 1 was called "Sample-A". Other Samples B, C, D, E, F and G were prepared in the same manner as in Example 1, except that the cyan coupler(s) mentioned below was(were) used.

| Sample | Cyan Coupler(s) |
|---|---|
| A | C - 3 |
| B | C - 1 |
| C | C - 9 |
| | c-a 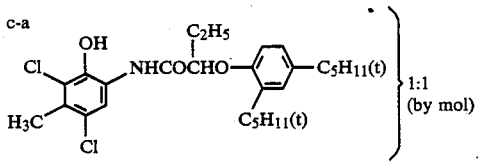 1:1 (by mol) |
| D | C - 10, c - a } 1 : 1 (by mol) |
| E | c - a |
| F | c - b 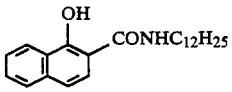 |
| G | c - c 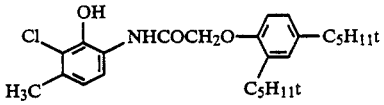 |

Next, each of the Samples A, B, C, D, E, F and G was processed in the same manner as in Example 2 with each of the processing solutions Nos. 3, 8, 13, 14 and 26 in Example 2. Then the change in the photographic characteristics of the processed samples was obtained. The results are shown in Table 3.

As is obvious from Table 3 , the change in the photographic characteristics in the processed samples was small when the samples were processed with stored color developers. The effect was particularly noticeable in the Samples (A, B, C and D) containing the preferred cyan couplers.

TABLE 3

| Test No. | 3 (Comparison) $\Delta D_R$min | $\Delta S_R$ | $\Delta D_R$max | 8 (Comparison) $\Delta D_R$min | $\Delta S_R$ | $\Delta D_R$max | 13 (Invention) $\Delta D_R$min | $\Delta S_R$ | $\Delta D_R$max |
|---|---|---|---|---|---|---|---|---|---|
| Sample A | +0.03 | −0.05 | +0.06 | +0.05 | −0.08 | +0.14 | +0.01 | +0.01 | 0 |
| B | +0.03 | −0.06 | +0.06 | +0.06 | −0.10 | +0.15 | +0.01 | +0.01 | +0.01 |
| C | +0.04 | −0.06 | +0.07 | +0.06 | −0.12 | +0.16 | +0.01 | +0.01 | +0.01 |
| D | +0.03 | −0.04 | +0.08 | +0.07 | −0.12 | +0.16 | 0 | 0 | +0.01 |
| E | +0.04 | −0.06 | +0.09 | +0.05 | −0.10 | +0.10 | +0.02 | +0.02 | +0.03 |
| F | +0.04 | −0.05 | +0.08 | +0.07 | −0.10 | +0.12 | +0.02 | +0.03 | +0.04 |
| G | +0.03 | −0.05 | +0.08 | +0.06 | −0.12 | +0.12 | +0.02 | +0.03 | +0.03 |

| Test No. | 14 (Invention) $\Delta D_R$min | $\Delta S_R$ | $\Delta D_R$max | 26 (Invention) $\Delta D_R$min | $\Delta S_R$ | $\Delta D_R$max |
|---|---|---|---|---|---|---|
| Sample A | 0 | 0 | 0 | 0 | 0 | −0.01 |
| B | 0 | 0 | +0.01 | 0 | 0 | 0 |
| C | 0 | 0 | +0.01 | 0 | +0.01 | +0.01 |
| D | 0 | 0 | +0.01 | 0 | +0.01 | +0.01 |
| E | +0.02 | +0.02 | +0.03 | +0.02 | +0.02 | +0.03 |
| F | +0.02 | +0.02 | +0.03 | +0.02 | +0.01 | +0.04 |
| G | +0.02 | +0.02 | +0.02 | +0.02 | +0.02 | +0.03 |

EXAMPLE 4

A multilayer color photographic paper was prepared by forming the layers having the compositions shown below on a paper support both surfaces of which were coated with polyethylene. The coating compositions for the layers were prepared as follows.

Coating Composition for First Layer 27.2 cc of ethyl acetate and 7.7 cc (8.0 g) of High Boiling Point Solvent (Solv-5) were added to 19.1 g of Yellow Coupler (ExY-2) and 4.4 g of Color Image Stabilizer (Cpd-17) and dissolved, and the resulting solution was dispersed by emulsification in 185 cc of an aqueous 10 wt % gelatin solution containing 8 cc of a 10 wt % sodium dodecylbenzenesulfonate solution. The emulsified dispersion and Emulsion (EM7) and Emulsion (EM8) were blended and dissolved and the gelatin concentration was adjusted as shown below to provide the coating composition for the first layer. Coating compositions for the second layer to the seventh layer were also prepared by the same manner as in the first layer. As a gelatin hardening agent for each layer, 1-hydroxy-3,5-dichloro-s-triazine sodium salt was used. As a thickening agent was used Compound (Cpd-17).

The compositions of the layers were as follows. The number after each ingredient means the amount coated ($g/m^2$). The amount of the silver halide emulsion coated means the amount of silver therein.

Support

Polyethylene-coated Paper, containing a white pigment ($TiO_2$) and a bluish dye in the polyethylene coat which is in contact with the first layer.

First Layer: Blue-sensitive Emulsion Layer

| | |
|---|---|
| Monodispersed Silver Chlorobromide Emulsion (EM7)(spectrally sensitized with Sensitizing Dye (ExS-6)) | 0.15 |
| Monodispersed Silver Chlorobromide Emulsion (EM8)(spectrally sensitized with Sensitizing Dye (ExS-6) | 0.15 |
| Gelatin | 1.86 |
| Yellow Coupler (ExY-2) | 0.82 |
| Color Image Stabilizer (Cpd-18) | 0.19 |
| Solvent (Solv-5) | 0.35 |

Second Layer: Color Mixing Preventing Layer

| | |
|---|---|
| Gelatin | 0.99 |
| Color Mixing Preventing Agent (Cpd-19) | 0.08 |

Third Layer: Green-sensitive Emulsion Layer

| | |
|---|---|
| Monodispersed Silver Chlorobromide Emulsion (EM9)(spectrally sensitized with Sensitizing Dye (ExS-7, 8)) | 0.12 |
| Monodispersed Silver Chlorobromide Emulsion (EM10)(spectrally sensitized with Sensitizing Dye (ExS-7, 8) | 0.24 |
| Gelatin | 1.24 |
| Magenta Coupler (ExM-2) | 0.39 |
| Color Image Stabilizer (Cpd-20) | 0.25 |
| Color Image Stabilizer (Cpd-21) | 0.12 |
| Solvent (Solv-6) | 0.25 |

Fourth Layer: Ultraviolet Absorbing Layer

| | |
|---|---|
| Gelatin | 1.60 |
| Ultraviolet Absorber (Cpd-22/Cpd-23/Cpd-24 = 3/2/6, by weight) | 0.70 |
| Color Mixing Preventing Agent (Cpd-25) | 0.05 |
| Solvent (Solv-7) | 0.42 |

Fifth Layer: Red-sensitive Emulsion Layer

| | |
|---|---|
| Monodispersed Silver Chlorobromide Emulsion (EM11)(spectrally sensitized with Sensitizing Dye (ExS-9, 10)) | 0.07 |
| Monodispersed Silver Chlorobromide Emulsion (EM12)(spectrally sensitized with Sensitizing Dye (ExS-9, 10) | 0.16 |
| Gelatin | 0.92 |
| Cyan Coupler (ExC-2) | 1.46 |
| Color Image Stabilizer (Cpd-23/Cpd-24/Cpd-26 = 3/4/2, by weight) | 0.17 |
| Dispersing Polymer (Cpd-27) | 0.14 |
| Solvent (Solv-5) | 0.20 |

Sixth Layer: Ultraviolet Absorbing Layer

| | |
|---|---|
| Gelatin | 0.54 |
| Ultraviolet Absorber (Cpd-22/Cpd-24/Cpd-26 = 1/5/3, by weight) | 0.21 |
| Solvent (Solv-8) | 0.08 |

Seventh Layer: Protective Layer

| | |
|---|---|
| Gelatin | 1.33 |
| Acryl-modified Polyvinyl Alcohol Copolymer (modification degree 17%) | 0.17 |
| Liquid Paraffin | 0.03 |

As an anti-irradiation dye were used Compounds Cpd-28 (20 $gm/m^2$ in Fourth Layer) and Cpd-29 (5 $mg/m^2$ in Second Layer).

In addition, Alkanol XC (by DuPont), sodium alkylbenzenesulfonate, succinic acid ester and Magefacx F-120 (by Dai-Nippon Ink & Chemicals) were used as an emulsification and dispersing agent and a coating assistant agent in each layer. As a stabilizer for silver halides were used Compounds Cpd−30 ($1 \times 10^{-4}$ mol/Agmol in First Layer) and Cpd−31 ($0.5 \times 10^{-3}$ to $1 \times 10^{-3}$ mol/Agmol in each silver halide emulsion layer).

The details of the emulsions used are as follows.

| Emulsion | Shape | Grain Size (μ) | Br Content (mol %) | Variation Coefficient (*) |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

(*) Grain size distribution = $\frac{\text{Standard Deviation}}{\text{Mean Grain Size}}$ The structural formulae of the compounds used are as follows.

ExY-2
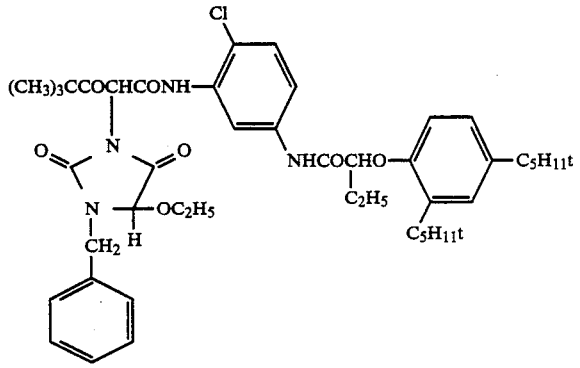
ExM-2
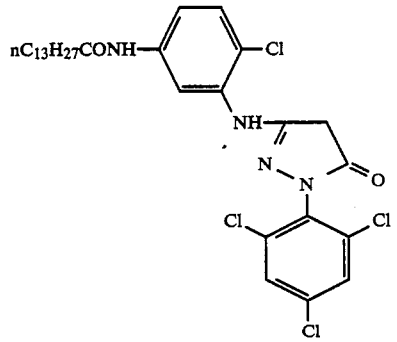
ExC-2
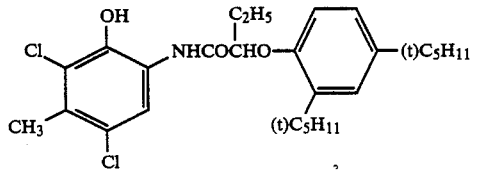
ExC-3
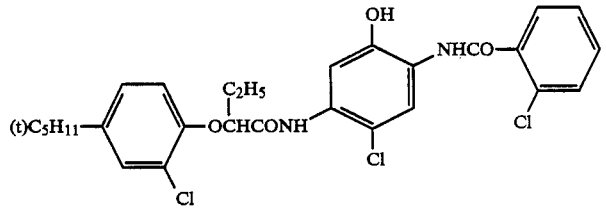
ExS-6
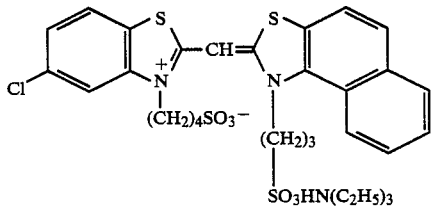
ExS-7
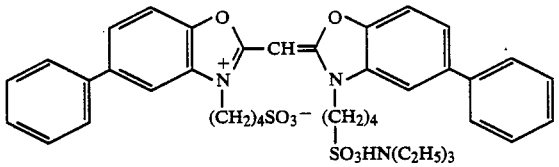

-continued
ExS-8
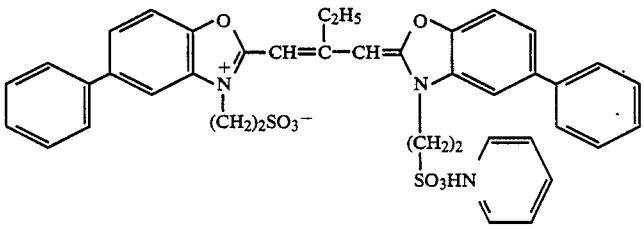
ExS-9
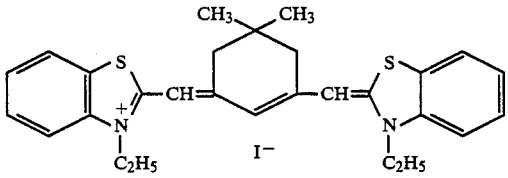
ExS-10
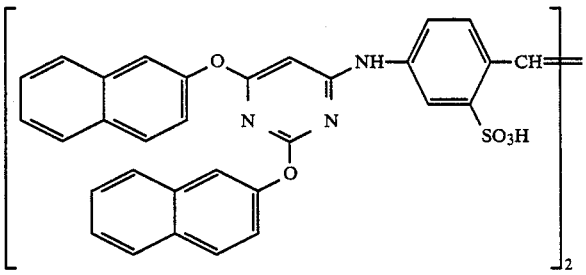
Cpd-17
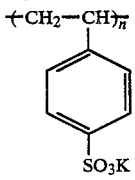
Cpd-18
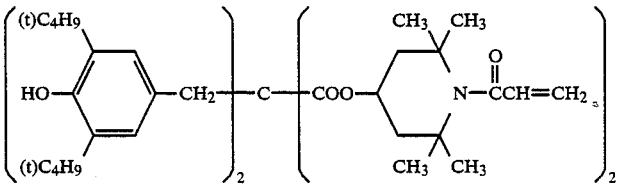
Cpd-19
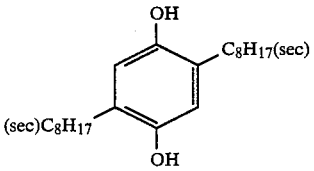
Cpd-20
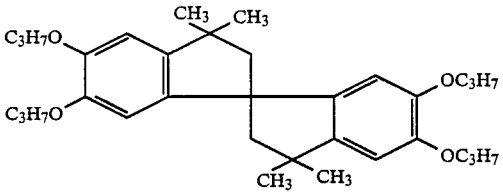

-continued
Cpd-21
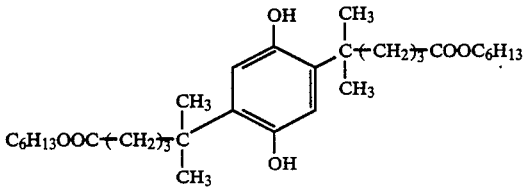
Cpd-22
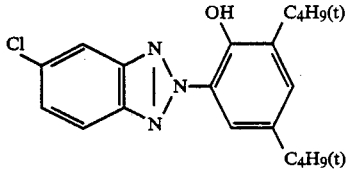
Cpd-23
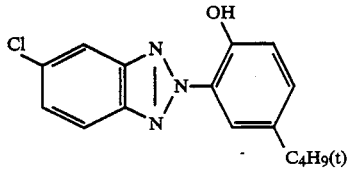
Cpd-24
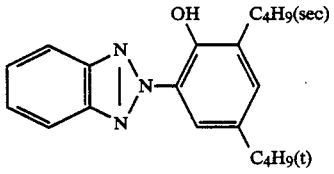
Cpd-25
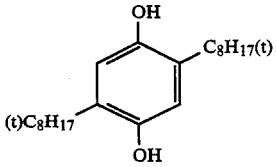
Cpd-26
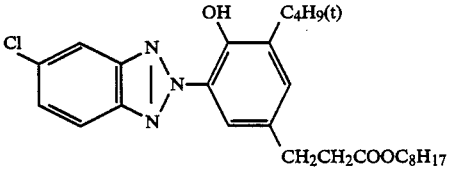
Cpd-27
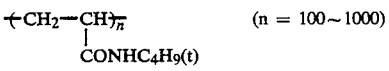
(n = 100~1000)
Cpd-28
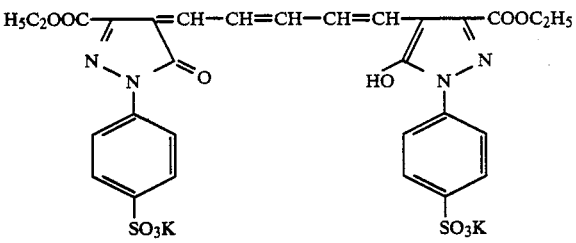

-continued

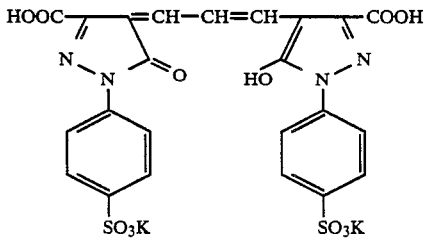

Cpd-29

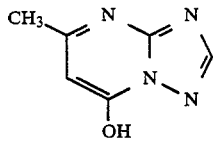

Cpd-30

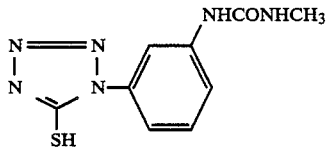

Cpd-31

Solv-5: Dibutyl Phthalate
Solv-6: Trioctyl Phosphate
Solv-7: Trinonyl Phosphate
Solv-8: Tricresyl Phosphate The color photographic paper thus prepared was processed in accordance with the procedure mentioned below.

| Processing Step | Temperature | Time |
|---|---|---|
| Color Development | 35° C. | 45 sec |
| Bleach-fixation | 35° C. | 45 sec |
| Stabilization (1) | 35° C. | 20 sec |
| Stabilization (2) | 35° C. | 20 sec |
| Stabilization (3) | 35° C. | 20 sec |
| Stabilization (4) | 35° C. | 30 sec |
| Drying | 80° C. | 60 sec |

The processing solutions used in the respective steps were as follows.

Color Developer

| | |
|---|---|
| Water | 800 ml |
| Ethylenediaminetetraacetic Acid | 2.0 g |
| Triethanolamine | 8.0 g |
| Sodium Chloride | 1.4 g |
| Potassium Carbonate | 25 g |
| Ferric Chloride (as iron ion concentration) | See Table 4 |
| Compound (I) | See Table 4 |
| Compound (II) | See Table 4 |
| N-Ethyl-N-(β-methanesulfonamidoethyl)-3-methyl-4-aminoaniline Sulfate | 5.0 g |
| Brightening Agent (4,4'-diaminostilbene type) | 2.0 g |
| Water to make | 1000 ml |
| pH (25° C.) | 10.05 |

Bleach-Fixing Solution

| | |
|---|---|
| $EDTAFe(III)NH_4.2H_2O$ | 60 g |
| $EDTA.2Na.2H_2O$ | 4 g |
| Ammonium Thiosulfate (70 wt %) | 120 ml |
| Sodium Sulfite | 16 g |
| Glacial Acetic Acid | 7 g |
| Water to make | 1000 ml |
| pH | 5.5 |

Stabilizing Solution

| | |
|---|---|
| Formalin (37 wt %) | 0.1 ml |
| 1-Hydroxyethylidene-1,1-diphosphonic Acid (60 wt %) | 1.6 ml |
| Bismuth Chloride | 0.35 g |
| Aqueous Ammonia (26 wt %) | 2.5 ml |
| Nitrilotriacetic Acid Trisodium Salt | 1.0 g |
| EDTA.4H | 0.5 g |
| Sodium Sulfite | 1.0 g |
| 5-Chloro-2-methyl-4-isothiazolin-3-one | 50 mg |
| Water to make | 1000 ml |

The color developer having the above-mentioned composition was placed in a beaker and stored under the condition of the opening ratio as indicated in Table 4 at 40° C. for the period of time also as indicated in Table 4. After being stored, the amount of the water evaporated was corrected by a supplement of a distilled water to the stored solution. Then the amount of the Compound (I) which remained in the solution was analyzed by high performance liquid chromatography, and the residual percentage (%) was obtained therefrom.

Next, the aforesaid color photographic paper was exposed through an optical wedge and then processed with each of the fresh color developer and the stored color developer. The change in yellow ($\Delta S_{0.5}$) as well as the change ($\Delta$Dmin) in the yellow minimum density (Dmin) were obtained in the same manner as in Example 1. The results obtained are shown in Table 4 below.

Table 4 indicates that the samples processed by the method of the present invention gave better results (Test Nos. 4 to 10). It is further noted than when the liquid opening ratio was made smaller, the effect by the combination of the Compound I) and the Compound (II) became greater (Test Nos. 13–17, Nos. 14–18, Nos. 15–19, Nos. 16–20), and when the Fe ion concentration in the developer was made higher, the effect also became greater (Test Nos. 25–27, Nos. 26–29, Nos. 27–30).

TABLE 4

| Test No. | Compound (I) 50 (mmol/l) | Compound (II) 1 (mmol/l) | Liquid Opening Ratio ($cm^{-1}$) | Sotred Period (day), at 40° C. | Fe ion Concentration (ppm) | $\Delta S_{0.5}$ (Yellow) | $\Delta D_{min}$ (Yellow) | Residual Percentage (%) of Compound (I) | Note |
|---|---|---|---|---|---|---|---|---|---|
| 1 | N,N-diethyl-hydroxylamine | — | 0.015 | 20 | 1.0 | −0.16 | +0.11 | 50 | Comparison |
| 2 | N,N-diethyl-hydroxylamine | II-6 | " | " | " | −0.14 | +0.09 | 58 | Comparison |
| 3 | I-7 | — | " | " | " | −0.11 | +0.09 | 70 | Comparison |
| 4 | " | II-6 | " | " | " | ±0 | +0.01 | 96 | Invention |
| 5 | " | II-1 | " | " | " | ±0 | ±0 | 90 | " |
| 6 | " | II-2 | " | " | " | ±0 | ±0 | 92 | " |
| 7 | " | II-3 | " | " | " | −0.01 | ±0 | 95 | " |
| 8 | I-12 | " | " | " | " | −0.01 | +0.01 | 91 | " |
| 9 | I-22 | " | " | " | " | ±0 | +0.01 | 94 | " |
| 10 | I-25 | " | " | " | " | −0.01 | +0.01 | 92 | " |
| 11 | N,N-diethyl-hydroxylamine | — | 0.30 | 4 | " | −0.18 | +0.13 | 20 | Comparison |
| 12 | N,N-diethyl-hydroxylamine | II-6 | " | " | " | −0.15 | +0.11 | 25 | Comparison |
| 13 | I-7 | — | " | " | " | −0.16 | +0.12 | 52 | Comparison |
| 14 | I-7 | — | 0.15 | 4 | 1.0 | −0.09 | +0.08 | 65 | Comparison |
| 15 | " | — | 0.05 | 15 | " | −0.13 | +0.09 | 48 | Comparison |
| 16 | " | — | 0.007 | 30 | " | −0.15 | +0.11 | 40 | Comparison |
| 17 | " | II-6 | 0.30 | 4 | " | −0.03 | +0.04 | 60 | Invention |
| 18 | " | II-10 | 0.15 | " | " | −0.03 | +0.02 | 79 | " |
| 19 | " | II-10 | 0.05 | 15 | " | −0.02 | +0.01 | 75 | " |
| 20 | " | II-10 | 0.007 | 30 | " | ±0 | +0.01 | 91 | " |
| 21 | N,N-diethyl-hydroxylamine | — | 0.05 | 15 | 0.01 | −0.19 | +0.13 | 25 | Comparison |
| 22 | N,N-diethyl-hydroxylamine | — | " | " | 2 | −0.23 | +0.20 | 21 | Comparison |
| 23 | N,N-diethyl-hydroxylamine | II-9 | " | " | 0.01 | −0.15 | +0.10 | 28 | Comparison |
| 24 | N,N-diethyl-hydroxylamine | " | " | " | 2 | −0.16 | +0.15 | 25 | Comparison |
| 25 | I-44 | — | " | " | 0.01 | −0.09 | +0.08 | 49 | Comparison |
| 26 | " | — | " | " | 0.08 | −0.15 | +0.12 | 41 | Comparison |
| 27 | " | — | " | " | 2 | −0.19 | +0.16 | 40 | Comparison |
| 28 | " | II-9 | 0.05 | 15 | 0.01 | −0.02 | +0.02 | 75 | Invention |
| 29 | " | " | " | " | 0.08 | −0.02 | +0.01 | 73 | " |
| 30 | " | " | " | " | 2 | −0.03 | +0.01 | 72 | " |
| 31 | I-48 | " | " | " | " | −0.02 | +0.02 | 75 | " |
| 32 | I-49 | " | " | " | " | −0.02 | +0.01 | 74 | " |

EXAMPLE 5

The same multilayer color photographic paper as in Example 4 was used and continuously processed for running test. The running test was conducted under the following two conditions (S) and (B). The running (A) means that the amount of the paper to be processed in a day was large; and the running (B) means that the amount was small.

Running (A) (for large amount processing):

Amount of Paper to be Processed: 15 $m^2$/day for continuous 10 days

Running (B) (for small amount processing):

Amount of Paper to be Processed: 2 $m^2$/day for continuous 75 days

The processing procedure comprised the following steps.

| Processing Step | Temp. | Time | Amount of Replenisher* | Tank Capacity |
|---|---|---|---|---|
| Color Developer | 35° C. | 45 sec | 120 ml | 10 l |
| Bleach-fixation | 30 to 36° C. | 45 sec | 200 ml | 10 l |
| Stabilization (1) | 30 to 37° C. | 20 sec | — | 5 l |
| Stabilization (2) | 30 to 37° C. | 20 sec | — | 5 l |
| Stabilization (3) | 30 to 37° C. | 20 sec | — | 5 l |
| Stabilization (4) | 30 to 37° C. | 30 sec | 180 ml | 5 l |
| Drying | 70 to 85° C. | 60 sec | | |

*The amount of the replenisher was per $m^2$ of the photographic paper which is being processed. The stabilization step was carried out by a four-tank countercurrent system from a stabilization bath (4) to a stabilization bath (1).

The processing solutions used had the following compositions.

Color Developer

| | Tank Solution | Relenisher |
|---|---|---|
| Water | 800 ml | 800 ml |
| Triethanolamine | 10 ml | 10 ml |
| Chelating Agent (see Table 5) | 0.02 mol | 0.02 mol |
| Preservative (see Table 5) | 0.04 mol | 0.06 mol |
| Sodium Chloride | 1.7 g | — |
| Potassium Carbonate | 30 g | 30 g |
| N-ethyl-N-(β-methnesulfonamidoethyl)-3-methyl-4-aminoaniline Sulfate | 5.0 g | 8.0 g |
| Brightening Agent (UVITEX CK, by Chiba-Geigy) | 2.0 g | 3.0 g |
| Water to make | 1000 ml | 1000 ml |
| pH (25° C.) | 10.05 | 10.65 |

Bleach-fixing Solution: (Tank solution and replenisher were same.)

| | |
|---|---|
| Water | 400 ml |
| Ammonium Thiosulfate (70 wt %) | 100 ml |
| Sodium Sulfite | 20 g |
| Ethylenediaminetetraacetic Acid/Iron(III) Ammonium Complex | 55 g |
| Ethylenediaminetetraacetic Acid Disodium Salt | 5 g |
| Glacial Acetic Acid | 7 g |
| Water to make | 1000 ml |
| pH (25° C.) | 5.60 |

Stabilizing Solution: (Tank solution and replenisher were same.)

| | |
|---|---|
| 1-Hydroxyethylidene-1,1-diphosphonic Acid (60 wt %) | 1.8 g |
| Nitrilotriacetic Acid | 1.5 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Aqueous Ammonia (26 wt %) | 1.5 ml |
| Water to make | 1000 ml |
| pH (25° C.) | 7.0 |

The color photographic paper sample was wedgewise exposed and then processed at the starting time and at the ending time of each of the running tests (A) and (B). Then the change in the yellow minimum density ($\Delta D_{Emin}$), the change in the magenta sensitivity ($\Delta S_G$) and the change in the magenta maximum density ($\Delta D_{Gmax}$) were obtained. The results are shown in Table 5 below.

TABLE 5

| No. | Additives: Chelating Agent | Additives: Preservative | Note | Running (A) (Large Amount Processing): $\Delta D_{Rmin}$ | $\Delta S_G$ | $\Delta D_{Gmax}$ | Running (B) (Small Amount Processing): $\Delta D_{Rmin}$ | $\Delta S_G$ | $\Delta D_{Gmax}$ |
|---|---|---|---|---|---|---|---|---|---|
| 1 | (25) | Hydroxylamine sulfate | Comparison | +0.05 | −0.09 | −0.18 | +0.10 | +0.13 | +0.27 |
| 2 | (68) | N,N-diethylhydroxylamine | " | +0.02 | −0.05 | −0.09 | +0.04 | +0.03 | +0.13 |
| 3 | Ethylenediamine-tetraacetic acid | I-7 | " | +0.03 | +0.04 | +0.7 | +0.05 | −0.08 | +0.03 |
| 4 | Hyroxyethylimino-diacetic acid | I-22 | " | +0.02 | +0.05 | +0.10 | +0.06 | −0.10 | +0.05 |
| 5 | (25) | I-7 | Invention | 0 | +0.01 | +0.02 | +0.01 | −0.02 | +0.02 |
| 6 | (57) | I-7 | " | 0 | +0.02 | +0.01 | +0.01 | −0.02 | +0.01 |
| 7 | (68) | I-7 | " | 0 | 0 | +0.02 | +0.01 | −0.01 | 0 |
| 8 | (68) | I-17 | " | 0 | +0.01 | 0 | 0 | −0.03 | 0 |
| 9 | (68) | I-22 | " | 0 | +0.01 | +0.02 | +0.01 | −0.02 | −0.02 |
| 10 | (68) | I-34 | " | 0 | +0.01 | +0.01 | +0.01 | −0.02 | 0 |
| 11 | (68) | I-7, II-2 (0.3 g/l) | " | 0 | 0 | 0 | 0 | 0 | 0 |
| 12 | (68) | I-7, II-6 (0.3 g/l) | " | 0 | 0 | 0 | 0 | 0 | 0 |

The results in Table 5 above indicate that the change in the photographic characteristics of the samples as processed by the method of the present invention was small, irrespective of the large amount processing of Running (A) and the small amount processing of Running (B). In particular, the change in $\Delta_{Dmin}$ was extremely improved to be almost negligible.

EXAMPLE 6

The same color photographic paper as that prepared in Example 4 was continuously processed in accordance with the running test procedure mentioned below. The test was continued until the amount of the replenisher added became three times of the capacity of the color developer tank. The composition of the color developer used was varied as indicated in Table 6 below.

| Processing Step | Temperature | Time | Amount of Replenisher |
|---|---|---|---|
| Color Development | 35° C. | 45 sec | 160 ml/m² |
| Bleach-fixation | 35° C. | 45 sec | 100 ml/m² |
| Rinsing (1) | 30° C. | 20 sec | — |
| Rinsing (2) | 30° C. | 20 sec | — |
| Rinsing (3) | 30° C. | 20 sec | 200 ml/m² |
| Drying | 60 to 70° C. | 30 sec | |

(The rinsing step was carried out by a three tank-countercurrent system from a rinsing tank (3) to a rinsing tank (1).)

The compositions of the respective processing solutions used were as follows.

Color Developer

| | Tank Solution | Replenisher |
|---|---|---|
| Methyltriethylenediamine(1,4-diazabicyclo[2,2,2]octane) | 5.0 g | 5.5 g |
| Compound (I) (see Table 6) | 50 mmol | 55 mmol |
| Compound (II) (see Table 6) | 1 mmol | 1.2 mmol |
| Ethylenediamine-N,N,N',N'-tetramethylenephosphonic Acid | 3.0 g | 4.0 g |
| Sodium Chloride | 1.4 g | 0.1 g |
| Potassium Carbonate | 30.0 g | 30.0 g |
| 4-Amino-3-methyl-N-ethyl-N-(β-methanesulfonamidoethyl)-3-methyl-4-aminoaniline | 5.0 g | 7.0 g |

-continued

| | Tank Solution | Replenisher |
|---|---|---|
| Sulfate | | |
| Water to make | 1000 ml | 1000 ml |
| pH (25° C.) | 10.10 | 10.50 |

Bleach-fixing Solution: (Tank solution and replenisher were the same.)

| | |
|---|---|
| EDTA Fe(III)$NH_4$.2$H_2O$ | 60 g |
| EDTA.2Na.2$H_2O$ | 4 g |
| Sodium Thiosulfate (70 wt %) | 120 ml |
| Sodium Sulfite | 16 g |
| Glacial Acetic Acid | 7 g |
| Water to make | 1000 ml |
| pH (25° C.) | 5.5 |

Rinsing Solution: (Tank solution and replenisher were the same.)

| | |
|---|---|
| EDTA.2Na.2$H_2O$ | 0.4 g |
| Water to make | 1000 ml |
| pH | 7.0 |

The color photographic paper prepared in Example 4 was exposed through an optical wedge and then processed in accordance with the procedure mentioned above, before and after the continuous running test. Then the change in the yellow minimum density ($\Delta D_{min}$) and the Change in the yellow gradation ($\Delta_\gamma$) were obtained. The gradation indicated the change in the density from the point showing a density of 0.5 to the point of a higher density with a higher exposure by 0.3 as logE. The results obtained are shown in Table 6 below and they demonstrate that the method of the present invention gave excellent results (Test Nos. 4 to 12).

TABLE 6

| Test No. | Compound (I) | Compound (II) | ΔDmin Yellow | Δr | Note |
|---|---|---|---|---|---|
| 1 | N,N'-diethylhydroxylamine | — | +0.05 | +0.04 | Comparison |
| 2 | " | II-2 | +0.03 | +0.04 | " |
| 3 | I-7 | — | +0.06 | +0.05 | " |
| 4 | " | II-2 | ±0 | ±0 | Invention |
| 5 | I-8 | II-3 | ±0 | +0.01 | " |
| 6 | I-10 | II-4 | ±0 | +0.01 | " |
| 7 | I-13 | II-5 | ±0 | ±0 | " |
| 8 | I-17 | II-6 | +0.01 | +0.01 | " |
| 9 | I-20 | II-7 | +0.01 | +0.01 | " |
| 10 | I-53 | II-8 | ±0 | +0.01 | " |
| 11 | I-55 | II-9 | ±0 | +0.01 | " |
| 12 | I-60 | II-10 | ±0 | +0.01 | " |

EXAMPLE 7

A multilayer color photographic paper was prepared by forming the layers having the compositions shown below on a paper support both surfaces of which were coated with polyethylene. The coating compositions for the layers were prepared as follows.

Coating Composition for First Layer 27.2 cc of ethyl acetate and 8.2 g of Solvent (Solv-11) were added to 19.1 g of Yellow Coupler (EXY), 4.4 g of Color Image Stabilizer (Cpd-32) and 0.7 g of Color Image Stabilizer (Cpd-38) and dissolved, and the resulting solution was dispersed by emulsification in 185 cc of an aqueous 10 wt % gelatin solution containing 8 cc of a 10 wt % sodium dodecylbenzenesulfonate solution. On the other hand, the following blue-sensitizing dye was added to a silver chlorobromide emulsion (cubic mean grain size 0.88 μ; grain size distribution variation coefficient 0.08; 0.2 mol % of silver bromide was on the surface of the grain) in an amount of $2.0\times10^{-4}$ mol per mol of silver and then the emulsion was sulfur-sensitized. The previously prepared dispersion and the emulsion were blended and dissolved to prepare the coating composition for the first layer, which had the composition mentioned below. Coating compositions for the second layer to the seventh layer were also prepared in the same manner as in the first layer. As a gelatin hardening agent for each layer, 1-hydroxy-3,5-dichloro-s-triazine sodium salt was used.

The following spectral sensitizing dyes were used for the respective layers.

Blue-sensitive Layer

Blue-sensitive Layer:

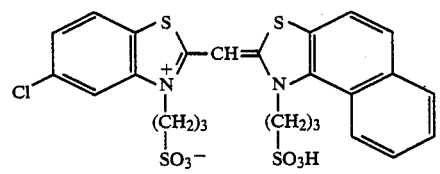

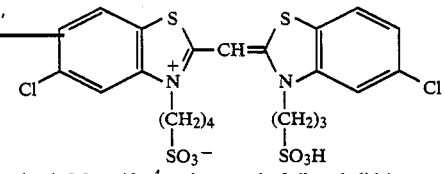

(each $2.0\times10^{-4}$ mol per mol of silver halide)

Green-sensitive Emulsion Layer

Green-sensitive Emulsion Layer:

-continued

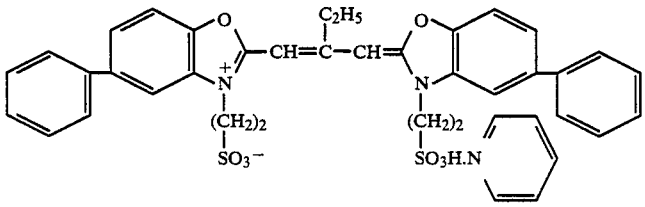

(4.0 × $10^{-4}$ mol per mol of silver halide)

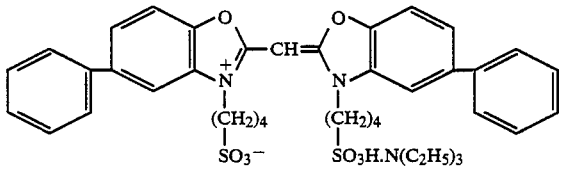

(7.0 × $10^{-5}$ mol per mol of silver halide)

Red-sensitive Emulsion Layer

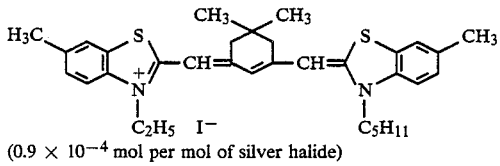

(0.9 × $10^{-4}$ mol per mol of silver halide)

To the red-sensitive emulsion layer was added the following compound in an amount of $2.6\times10^{-3}$ mol per mol of silver halide.

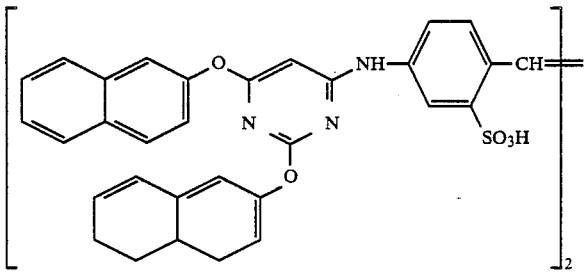

To the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, respectively, per mol of silver halide.

For anti-irradiation, the following dyes were added to the emulsion layer.

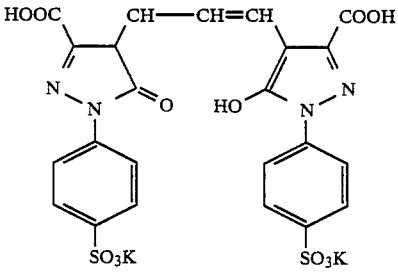

(15 mg/$m^2$ in an interlayer between blue- and green-sensitive layers)

and

-continued

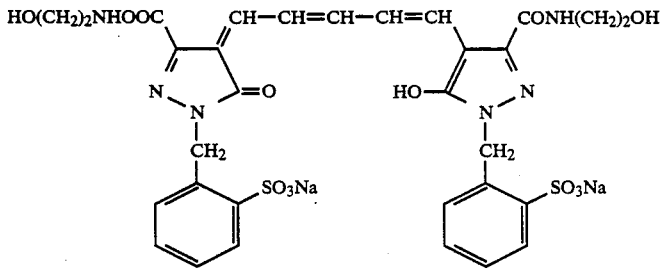

(5 mg/m$^2$ in an interlayer between green- and red-sensitive layers)

The compositions of the layers were as follows. The numerical value after each ingredient means the amount coated (g/m$^2$). The amount of the silver halide emulsion coated means the amount of silver therein.

Support

Polyethylene-coated Paper, containing a white pigment ($TiO_2$) and a bluish dye (ultramarine) in the polyethylene coat ing in contact with the first layer.

First Layer: Blue-sensitive Emulsion Layer

| | |
|---|---|
| Silver Chlorobromide Emulsion | 0.30 |
| Gelatin | 1.86 |
| Yellow Coupler (ExY) | 0.82 |
| Color Image Stabilizer (Cpd-32) | 0.19 |
| Solvent (Solv-11) | 0.35 |
| Color Image Stabilizer (Cpd-37) | 0.06 |

Second Layer: Color Mixing Preventing Layer

| | |
|---|---|
| Gelatin | 0.99 |
| Color Mixing Preventing Agent (Cpd-35) | 0.08 |
| Solvent (Solv-9) | 0.16 |
| Solvent (Solv-12) | 0.08 |

Third Layer: Green-sensitive Emulsion Layer

| | |
|---|---|
| Silver Chlorobromide Emulsion ($\phi$ mixture (As Ag molar ratio) of cubic grains with mean grain size of 0.55$\mu$ and grain size distribution variation coefficient of 0.10 and cubic grains with mean grain size of 0.39$\mu$ and grain size distribution variation coefficient of 0.08; 0.8 mol % of AgBr being locally on the surface of the grain) | 0.12 |
| Gelatin | 1.24 |
| Magenta Coupler (ExM) | 0.27 |
| Color Image Stabilizer (Cpd-33) | 0.15 |
| Color Image Stabilizer (Cpd-38) | 0.02 |
| Color Image Stabilizer (Cpd-39) | 0.03 |
| Solvent (Solv-10) | 0.54 |

Fourth Layer: Ultraviolet Absorbing Layer

| | |
|---|---|
| Gelatin | 1.58 |
| Ultraviolet Absorber (UV-1) | 0.47 |
| Color Mixing Preventing Agent (Cpd-35) | 0.05 |
| Solvent (Solv-13) | 0.24 |

Fifth Layer: Red-sensitive Emulsion Layer

| | |
|---|---|
| Silver Chlorobromide Emulsion (¼ mixture (as Ag molar ratio) of cubic grains with mean grain size of 0.58$\mu$ and grain size distribution variation coefficient of 0.09 and cubic grains with mean grain size of 0.45$\mu$ and grain size distribution variation coefficient of 0.11; 0.6 mol % of AgBr being locally on a part of the surface of the grain) | 0.23 |
| Gelatin | 1.34 |
| Cyan Coupler (ExC) | 0.32 |
| Color Image Stabilizer (Cpd-36) | 0.17 |
| Color Image Stabilizer (Cpd-40) | 0.04 |
| Color Image Stabilizer (Cpd-37) | 0.40 |
| Solvent (Solv-14) | 0.15 |

Sixth Layer: Ultraviolet Absorbing Layer

| | |
|---|---|
| Gelatin | 0.53 |
| Ultraviolet Absorber (UV-1) | 0.16 |
| Color Mixing Preventing Agent (Cpd-35) | 0.02 |
| Solvent (Solv-13) | 0.08 |

Seventh Layer: Protective Layer

| | |
|---|---|
| Gelatin | 1.33 |
| Acryl-modified Polyvinyl Alcohol Copolymer (modification degree 17%) | 0.17 |
| Liquid Paraffin | 0.03 |

The structural formulae of the compounds used are as follows:

Yellow Coupler (ExY)

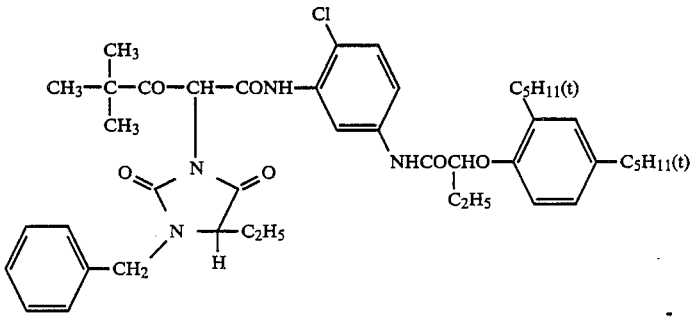
Magenta Coupler (ExM)
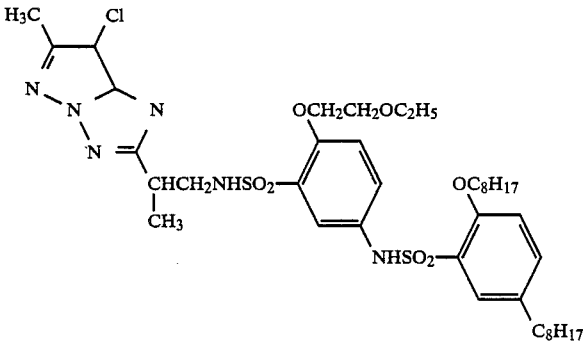
Cyan Coupler (ExC)
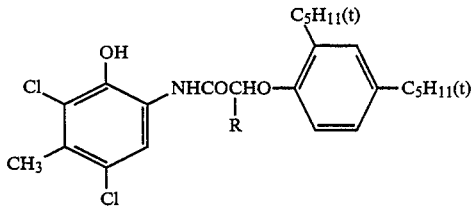
R = $C_2H_5$, $C_4H_9$ and
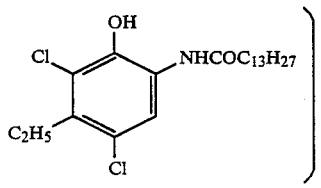
Color Image Stabilizer (Cpd-32)
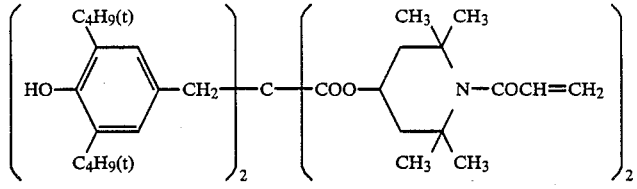
Color Image Stabilizer (Cpd-33)
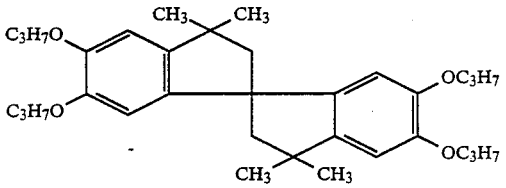
Color Image Stabilizer (Cpd-34)
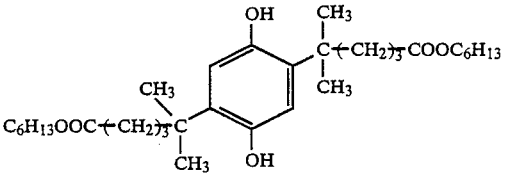

Color Mixing Preventing Agent (Cpd-35)
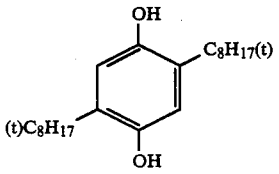
Color Image Stabilizer (Cpd-36)
2/4/4 mixture (by weight) of
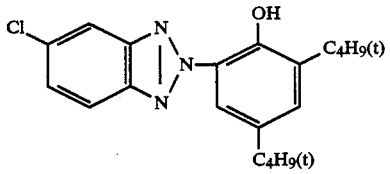
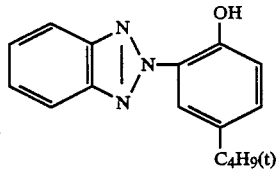
and
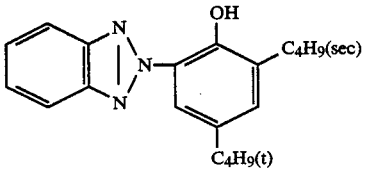
Color Image Stabilizer (Cpd-37)
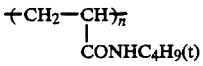
(mean molecular weight: 60,000)
Color Image Stabilizer (Cpd-38)
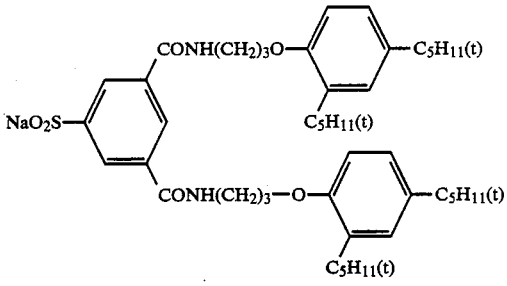
(Cpd-39)
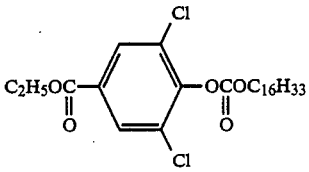
Color Image Stabilizer (Cpd-40)
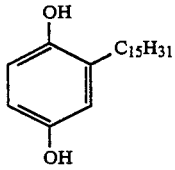
Ultraviolet Absorber (UV-1)
4/2/4 mixture (by weight) of
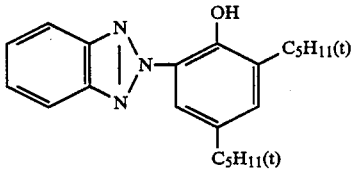
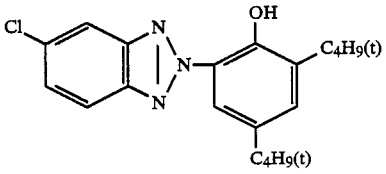
and
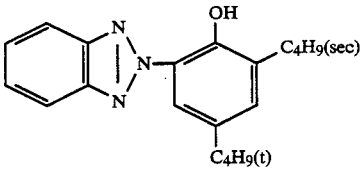
Solvent (Solv-9)
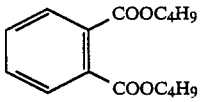
Solvent (Solv-10)
2/1 mixture (by weight) of
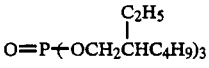
and -continued

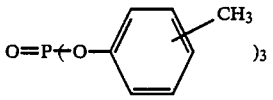

Solvent (Solv-11)

$O{=}P{-}(O{-}C_9H_{19}(iso))_3$

Solvent (Solv-12)

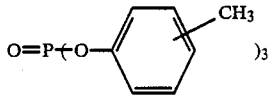

Solvent (Solv-13)

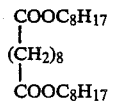

Solvent (Solv-14)

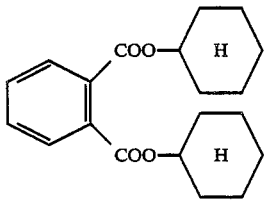

The color photographic paper thus prepared was processed in the same manner as in Example 5. After the two running tests, excellent results were obtained in both cases, irrespective of the large amount processing of the running test (A) and the small amount processing of the running test (B).

EXAMPLE 8

A multilayer color photographic material was prepared by forming the following layers on a paper support both surfaces of which were coated with polyethylene.

Ninth Emulsion Layer: Protective Layer

Eighth Emulsion Layer: Ultraviolet Absorbing Layer

Seventh Emulsion Layer: Blue-sensitive Layer

Sixth Emulsion Layer: Ultraviolet Absorbing Layer

Fifth Emulsion Layer: Yellow Filter Layer

Fourth Emulsion Layer: Ultraviolet Absorbing Layer

Third Emulsion Layer: Green-sensitive Layer

Second Emulsion Layer: Ultraviolet Absorbing Layer

First Emulsion Layer: Red-sensitive Layer Support

First Backing Layer: Curling Preventing Layer

Second Backing Layer: Protective Layer

The coating compositions for the respective layers were prepared as follows:

Coating Composition for First Emulsion Layer 40 cc of ethyl acetate and 7.7 cc of Solvent (ExS-1) were added to 13.4 g of Cyan coupler (ExCC-1), 5.7 g of Color Image Stabilizer (ExSA-1) and 10.7 g of Polymer (ExP 1) to dissolve them, and the resulting solution was dispersed by emulsification in 185 cc of an aqueous 10 wt % gelatin solution containing 8 cc of a 10 wt % sodium dodecylbenzenesulfonate solution. On the other hand, the following red-sensitizing dye was added to an internal latent image-type emulsion (containing 63 g/kg Ag) in an amount of $2.5\times10^{-4}$ mol per mol of silver. The previously prepared dispersion was blended with the resulting emulsion and dissolved to provide the coating composition for the first layer having the composition mentioned below. The coating compositions for the second emulsion layer to the ninth emulsion layer and the first backing layers and the second backing layer were also prepared by the same manner as in the first layer. As a gelatin hardening agent for each layer, 90 mg/m$^2$ of 1-hydroxy-3,5-dichloro-s-triazine sodium salt was used.

The following spectral sensitizing dyes were used for the respective layers.

Red-sensitive Emulsion Layer

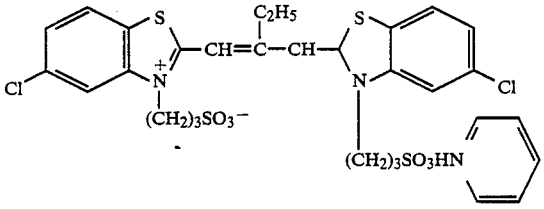

($2.5\times10^{-4}$ mol per mol of silver halide)

Green-sensitive Emulsion Layer

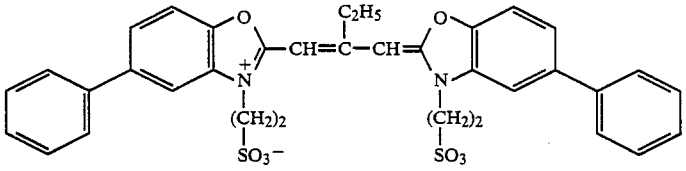

($3.1\times10^{-4}$ mol per mol of silver halide)

Blue-sensitive Emulsion Layer

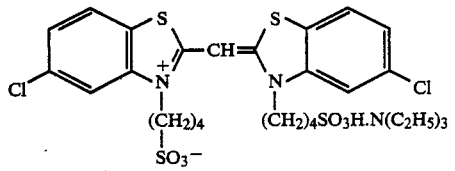

(4.3 × $10^{-4}$ mol per mol of silver halide)

The following dyes were used as an anti-irradiation dye.

Anti-irradiation Dye for Green-sensitive Emulsion Layer

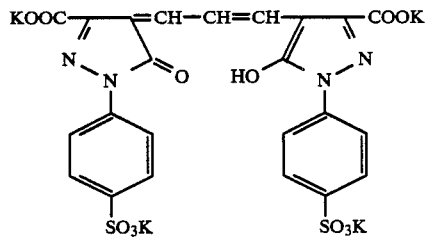

(20 mg/$m^2$ in Third Layer)

Anti-irradiation Dye for Red-sensitive Emulsion Layer

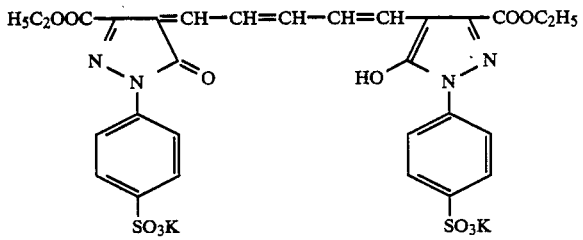

(5 mg/$m^2$ in First Layer)

The compositions of the layers were as follows. The numerical value after each ingredient means the amount coated per $m^2$. The amount of the silver halide and that of the colloidal silver each means the amount of silver therein.

Support

Polyethylene-coated paper, containing a white pigment ($TiO_2$) and a blueish dye (ultramarine) in the polyethylene coating in contact with the first layer.

First-Emulsion Layer

| | |
|---|---|
| Silver Halide Emulsion | 0.39 g |
| Gelatin | 1.35 g |
| Cyan Coupler (ExCC-1) | 0.40 g |
| Color Image Stabilizer (ExSA-1) | 0.17 g |
| Polymer (ExP-1) | 0.32 g |
| Solvent (ExS-1) | 0.23 g |
| Development Adjusting Agent (ExGC-1) | 32 mg |
| Stabilizer (ExA-1) | 5.8 mg |
| Nucleation Accelerator (ExZS-1) | 0.37 g |

-continued

| | |
|---|---|
| Nucleating Agent (ExZK-1) | 9.9 μg |

Second Emulsion Layer

| | |
|---|---|
| Gelatin | 1.6 g |
| Ultraviolet Absorber (ExUV-1) | 0.62 g |
| Color Mixing Preventing Agent (ExKB-1) | 0.06 g |
| Solvent (ExS-2) | 0.24 g |

Third Emulsion Layer

| | |
|---|---|
| Silver Halide Emulsion | 0.27 g |
| Gelatin | 1.79 g |
| Magenta Coupler (ExMC-1) | 0.32 g |
| Color Image Stabilizer (ExSA-2) | 0.20 g |
| Solvent (ExS-3) | 0.65 g |
| Development Adjusting Agent (ExGC-1) | 22 mg |
| Stabilizer (ExA-1) | 4 mg |
| Nucleation Accelerator (ExZS-1) | 0.26 g |
| Nucleating Agent (ExZK-1) | 3.4 μg |

Fourth Emulsion Layer

| | |
|---|---|
| Gelatin | 0.53 g |
| Ultraviolet Absorber (ExUV-1) | 0.21 g |
| Color Mixing Preventing Agent (ExKB-2) | 0.02 g |
| Solvent (ExS-2) | 0.08 g |

Fifth Emulsion Layer

| | |
|---|---|
| Colloidal Silver | 0.10 g |
| Gelatin | 0.53 g |
| Ultraviolet Absorber (ExUV-1) | 0.21 g |
| Color Mixing Preventing Agent (ExKB-2) | 0.02 g |
| Solvent (ExS-2) | 0.08 g |

Sixth Emulsion Layer

Same as Fourth Emulsion Layer.

Seventh Emulsion Layer

| | |
|---|---|
| Silver Halide Emulsion | 0.26 g |
| Gelatin | 1.83 g |
| Yellow Coupler (ExYC-1) | 0.83 g |
| Color Image Stabilizer (ExSA-3) | 0.19 g |
| Solvent (ExS-4) | 0.35 g |
| Development Adjusting Agent (ExGC-1) | 32 mg |
| Stabilizer (ExA-1) | 2.9 mg |
| Nucleation Accelerator (ExZS-1) | 0.2 mg |

-continued

| | |
|---|---|
| Nucleating Agent (ExZK-1) | 2.5 μg |

Eighth Emulsion Layer

| | |
|---|---|
| Gelatin | 0.53 mg |
| Ultraviolet Absorber (UV-1) | 0.21 g |
| Solvent (Solv-3) | 0.08 g |

Ninth Emulsion Layer

| | |
|---|---|
| Gelatin | 1.33 mg |
| Acrylmodified Polyvinyl Alcohol Copolymer (modification degree 17%) | 0.17 g |
| Liquid Paraffin | 0.03 g |
| Latex Grains of Polymethyl methacrylate (mean grain size: 2.8 μm) | 0.05 g |

First Backing Layer

| | |
|---|---|
| Gelatin | 8.7 g |

Second Backing Layer

Same as Ninth Emulsion Layer.
The Compounds used were as follows:

Solvent (ExS-1)

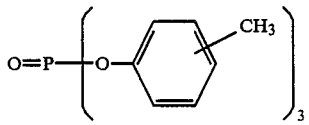

Solvent (ExS-2)

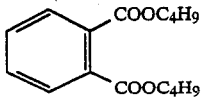

Solvent (ExS-3) 1:1 (by volume) mixture of

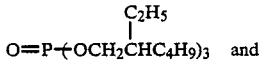

and

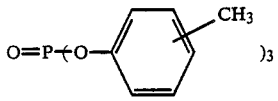

Solvent (ExS-4)

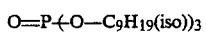

Cyan Coupler (ExCC-1)

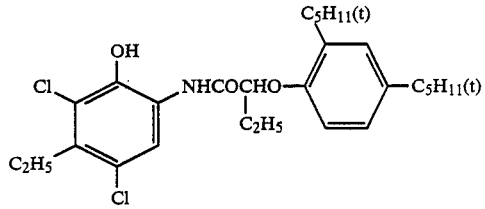

Magenta Coupler (ExMC-1)

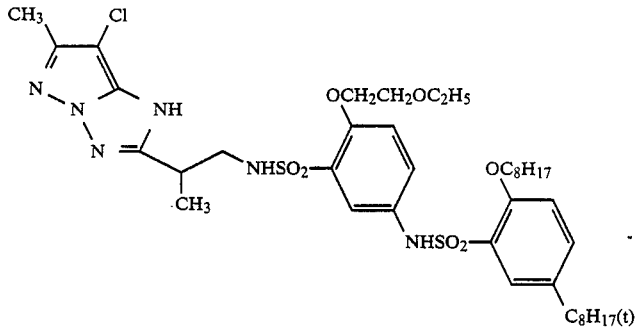

Yellow Coupler (ExYC-1)
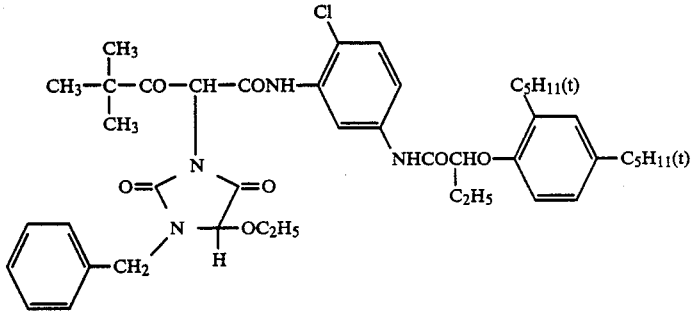
Color Image Stabilizer (ExSA-1)
5/8/9 mixture (by weight) of
5/8/9 mixture (by weight) of
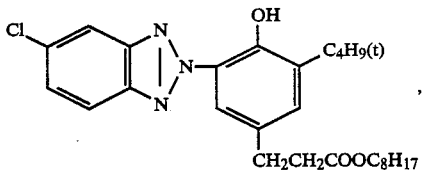
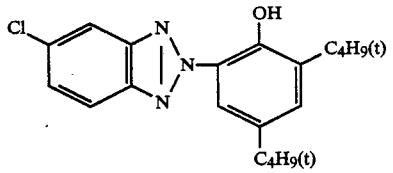
and
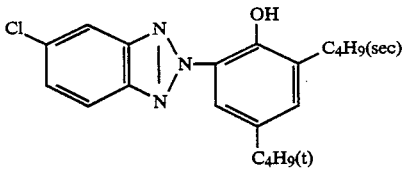
Color Image Stabilizer (ExSA-2)
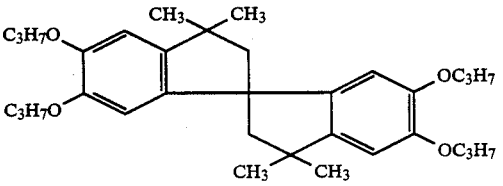
Color Image Stabilizer (ExSA-3)
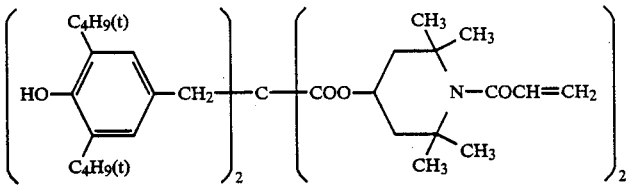
Ultraviolet Absorber (ExUV-1)
2/9/8 (by weight) mixture of
2/9/8 (by weight) mixture of
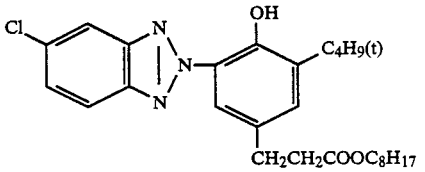
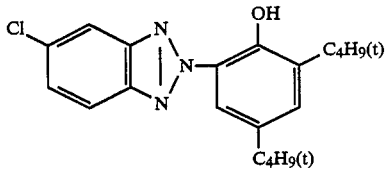
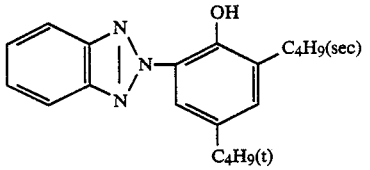
Color Mixing Preventing Agent (ExKB-1)
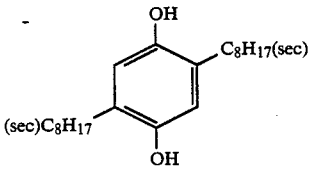

Color Mixing Preventing Agent (ExKB-2)

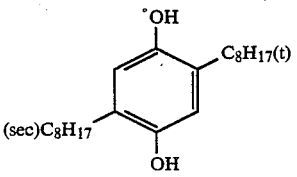

Development Adjusting Agent (ExGC-1)

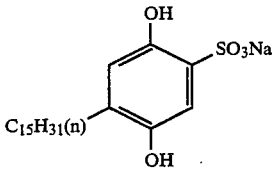

Stabilizer (ExA-1)

4-Hydroxy-6-methyl-1,3,3a,7-tetraazaindene (ExZS-1): 2-(3-Dimethylaminopropylthio)-5-mercapto1,3,4-thiadiazole Hydrochloride ExZK-1) 6-Ethoxythiocarbonylamino-2-methyl-1-propargylquinonlinium Trifuluoromethanesulfonate The photographic material thus prepared was called Sample (I), and this was processed for running test in accordance with the procedure comprising the steps mentioned below.

| Processing Step | Temperature | Time | Amount of Replenisher |
|---|---|---|---|
| Color Development | 38° C. | 1 min 30 sec | 300 ml/m$^2$ |
| Bleach-fixation | 35° C. | 40 sec | 300 ml/m$^2$ |
| Rinsing (1) | 30 to 36° C. | 40 sec | — |
| Rinsing (2) | 30 to 36° C. | 40 sec | — |
| Rinsing (3) | 30 to 36° C. | 15 sec | 320 ml/m$^2$ |
| Drying | 75 to 80° C. | 30 sec | |

(The rinsing step was carried out by a so-called three-tank countercurrent system where a fresh rinsing water was introduced into the rinsing bath (3), the overflow from the rinsing bath (3) was introduced into the previous rinsing bath (2), and the overflow from the rinsing bath (2) was further introduced into the previous rinsing bath (1), whereupon the amount of the carryover of the liquid from the previous bath together with the material being processed was 35 ml/m$^2$.)

The processing solutions used had the following compositions.

Color Developer

| | Tank Solution | Replenisher |
|---|---|---|
| Diethylene Glycol | 8.0 g | 13.0 g |
| Benzyl Alcohol | 12.0 g | 18.5 g |
| Sodium Bromide | 0.7 g | — |
| Sodium Chloride | 0.5 g | — |
| Sodium Sulfite (SS) | See Table 7 | |
| Chelating Agent (see Table 7) | 0.01 M | 0.01 M |
| Preservative (see Table 7) | 0.05 M | 0.07 M |
| 3-Methyl-4-amino-N-ethyl-N-(β-methanesulfonamidoethyl)aniline | 5.5 g | 8.0 g |
| Potassium Carbonate | 30.0 g | 30.0 g |
| Brightening Agent (stilbene type) | 1.0 g | 1.3 g |
| Pure Water to make | 1000 ml | 1000 ml |
| pH | 10.50 | 10.90 |

(pH was adjusted with potassium hydroxide or hydrochloric acid.)

Bleach-fixing Solution: (Tank solution and replenisher were same.)

| | |
|---|---|
| Ammonium Thiosulfate | 100 g |
| Ethylenediaminetetraacetic Acid/Iron(III) Ammonium Complex Dihydrate | 50.0 g |
| Ethylenediaminetetraacetic Acid Disodium Salt Dihydrate | 5.0 g |
| Pure Water to make | 1000 ml |
| pH | 6.3 |

(pH was adjusted with aqueous ammonia or hydrochloric acid.)

Rinsing Water

A city water was subjected to ion-exchange treatment so that the concentration of all cations except hydrogen ion and the concentration of all anions except hydroxyl ion each was lowered to 1 ppm or less. The resulting pure water was used as the rinsing water, and the tank solution and the replenisher were the same.

Sample (I) was wedgewise exposed and then processed both at the starting of the running test and at the ending thereof. Then the change in the minimum density and sensitivity (ΔDmin and ΔS) of yellow, magenta and cyan colors was determined. The results obtained ar shown in Table 7 below.

As is obvious from Table 7, the increase of stain was small and the change of sensitivity was also small, when the sample was processed by the method of the present invention. In particular, the effect was noticeable when the processing solution contained no sulfite ion.

TABLE 7

| Test No. | Aditives: Chelating Agent | Aditives: Preservative | Aditives: SS (Tank Solution/ Replenisher) | Note | ΔDmin Y | ΔDmin M | ΔDmin C | ΔS Y | ΔS M | ΔS C |
|---|---|---|---|---|---|---|---|---|---|---|
| 1 | (68) | N,N-diethylhydroxylamine | — | Comparison | +0.04 | +0.04 | +0.02 | +0.08 | +0.09 | +0.10 |
| 2 | " | N,N-diethylhydroxylamine | 2.0 g/2.5 g | " | +0.02 | +0.01 | 0 | +0.13 | +0.14 | +0.15 |
| 3 | " | I-7 | 2.0 g/2.5 g | Invention | +0.01 | 0 | 0 | +0.04 | +0.04 | +0.04 |
| 4 | " | I-7 | — | " | +0.01 | 0 | 0 | +0.01 | 0 | 0 |
| 5 | " | I-17 | — | " | +0.01 | 0 | 0 | +0.02 | +0.02 | +0.02 |
| 6 | " | I-22 | — | " | +0.01 | 0 | 0 | +0.02 | +0.02 | +0.01 |
| 7 | " | I-7, II-2 (0.3 g/l) | — | " | 0 | 0 | 0 | 0 | 0 | 0 |

TABLE 7-continued

| Test No. | Aditives: Chelating Agent | Preservative | SS (Tank Solution/ Replenisher) | Note | ΔDmin Y | ΔDmin M | ΔDmin C | ΔS Y | ΔS M | ΔS C |
|---|---|---|---|---|---|---|---|---|---|---|
| 8 | " | I-7, II-6 (0.3 g/l) | — | " | 0 | 0 | 0 | 0 | 0 | 0 |

EXAMPLE 9

The same running test as the Test No. 4 of Example 8 was repeated, except that the chelating agent (68) was replaced by (1), (8), (17), (25), (30), (36), (46), (57) or (60), and the same favorable results were obtained.

EXAMPLE 10

Various color photographic papers were prepared by the same process as in Example 1, whereupon the bromine content in the emulsions EM5 and EM6 was varied as indicated in Table 8 below. On the other hand, various color developers were prepared, following the preparation of the color developer in Example 1, except that Compound (I) and Compound (II) used were as indicated in Table 8. Each of these color developers was stored in a beaker with an opening ratio of 0.065 cm-$^{1}$ at 35° C. for 10 days. The color photographic paper samples prepared above were exposed through an optical wedge and then processed with each of the fresh and stored color developers. The processing procedure was the same as that in Example 1.

After being processed, the Dmin of cyan color of each sample was measured, and the change in Dmin of cyan color (ΔDmin) was obtained. The results are shown in Table 8.

As is obvious from Table 8, excellent results were obtained in accordance with the method of the present invention. In particular, the effect by the combination of the Compounds (I) and (II) is more remarkable when the bromine content in the photographic papers was small (Test Nos. 1–5, Nos. 2–6, Nos. 3–7, Nos. 4–8).

TABLE 8

| Test No. | Br-Content (mol %) | Compound (I) | Compound (II) | ΔDmin Cyan | Note |
|---|---|---|---|---|---|
| 1 | 30 | — | II-6 | +0.12 | Comparison |
| 2 | 10 | — | " | +0.12 | Comparison |
| 3 | 2 | — | " | +0.15 | Comparison |
| 4 | 1 | — | " | +0.16 | Comparison |
| 5 | 30 | I-7 | " | +0.03 | Invention |
| 6 | 10 | " | " | +0.03 | " |
| 7 | 2 | " | " | ±0 | " |
| 8 | 1 | " | " | ±0 | " |
| 9 | 1 | I-28 | II-2 | +0.01 | " |
| 10 | 1 | I-44 | II-3 | +0.01 | " |
| 11 | 30 | Diethylhydroxylamine | " | +0.08 | Comparison |
| 12 | 2 | Diethylhydroxylamine | " | +0.07 | Comparison |
| 13 | 1 | Diethylhydroxylamine | " | +0.07 | Comparison |

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which has been imagewise exposed, comprising processing the exposed photographic material with a color developer which contains an aromatic primary amine developing agent, at least one compound of the following formula (I) and at least one compound of the following formula (II) and which has an opening ratio of 0.20 cm$^{-1}$ or less:

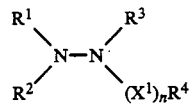

(I)

wherein $R^1$, $R^2$ and $R^3$ independently represent a hydrogen atom, an alkyl group, an aryl group or a heterocyclic group;

$R^4$ represents a hydrogen atom, a hydroxyl group, a hydrazino group, an alkyl group, an aryl group, a heterocyclic group, an alkoxy group, an aryloxy group, a carbamoyl group or an amino group;

$X^1$ represents a divalent group;

n represents 0 or 1; and when n is O, $R^4$ represents an alkyl group, an aryl group or a heterocyclic group; and $R^3$ and $R^4$ may together form a heterocyclic group

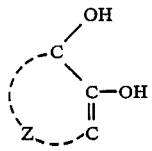

(II)

where Z represents an atomic group which completes and forms an aromatic nucleus.

2. A method for processing a silver halide color photographic material as in claim 1, in which the amount of the compound of formula (I) in the color developer is from 0.01 to 50 g.

3. A method for processing a silver halide color photographic material as in claim 1, in which the amount of the compound of formula (II) in the color developer is from 0.00005 to 0.1 mol.

4. A method for processing a silver halide color photographic material as in claim 1, in which the color developer further contains one or more organic phosphonic acid chelating agents selected from the compounds of the following formulae (III), (IV), (V), (VI), (VII), (VIII), (IX), (X) and (XI):

ti $B—A_1—Z—A_2—C$ (III)

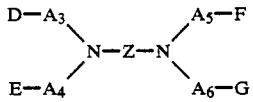

(IV)

wherein in formulae (III) and (IV), $A_1$ to $A_6$ each represents a substituted or unsubstituted alkylene group; Z represents an alkylene group, a cyclohexylene group, a phenylene group, —R—O—R, —ROROR—,

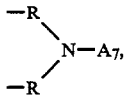

where R is an alkylene group, or >N—$A_7$, where $A_7$ is a hydrogen atom, a hydrocarbon group, a lower aliphatic carboxylic acid residue or a lower alcohol residue, B, C, D, E, F, and G each represents —OH, —COOM, —$PO_3M_2$, where M is a hydrogen atom, an alkali metal or an ammonium group; and at least one of B, C, D, E, F, and G is —$PO_3M_2$;

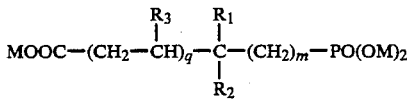

(V)

where $R_1$ represents —COOM or —$PO(OM)_2$;

$R_2$ represents a hydrogen atom, an alkyl group having from 1 to 4 carbon atoms, —$(CH_2)_{n'}$COOM or a phenyl group;

$R_3$ represents a hydrogen atom or —COOM;

M represents a hydrogen atom, an alkali metal or an ammonium group;

m represents 0 or 1;

n' represents an integer of from 1 to 4;

q represents 0 or 1;

provided that when m is 0, $R_1$ is —$PO(OM)_2$;

$$R_4N(CH_2PO_3M_2)_2 \quad \text{(VI)}$$

where $R_4$ represents a lower alkyl group, an aryl group, an aralkyl group or a nitrogen-containing 6-membered heterocyclic group, which may be substituted by one or more substituents selected from —OH, —$OR_5$, where $R_5$ is an alkyl group having from 1 to 4 carbon atoms, —$PO_3M_2$, —$CH_2PO_3M_2$, —$N(CH_2PO_3M_2)_2$, —$COOM_2$ and —$N(CH_2COOM_2)$;

M represents a hydrogen atom, an alkali metal or an ammonium group;

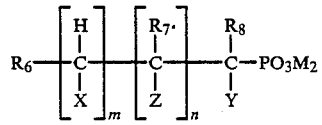

(VII)

where $R_6$ and $R_7$ each represents a hydrogen atom, a lower alkyl group, —COOH or —$NJ_2$, where J is —H, —OH, a lower alkyl group or —$C_2H_4OH$;

$R_8$ represents a hydrogen atom, a lower alkyl group, —OH or —$NL_2$, where L is —H, —OH, —$CH_3$, —$C_2H_5$, —$C_2H_4OH$ or —$PO_3M_2$: X, Y, and Z each represents —OH, —COOM, —$PO_3M_2$ or —H;

M represents a hydrogen atom, an alkali metal or an ammonium group;

n represents 0 or an integer of 1 or more;

m represents 0 or 1;

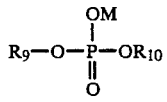

(VIII)

where $R_9$ and $R_{10}$ each represents a hydrogen atom, an alkali metal, an ammonium group or a substituted or unsubstituted alkyl, alkenyl or cyclic alkyl group having from 1 to 12 carbon atoms, and M represents a hydrogen atom, an alkali metal or an ammonium group;

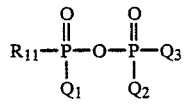

(IX)

where $R_{11}$ represents an alkyl group having from 1 to 12 carbon atoms, an alkoxy group having from 1 to 12 carbon atoms, a monoalkylamino group having from 1 to 12 carbon atoms, a dialkylamino group having from 2 to 12 carbon atoms, an amino group, an aryloxy group having from 1 to 24 carbon atoms, an arylamino group having from 6 to 24 carbon atoms or an acyloxy group;

$Q_1$ to $Q_3$ each represents —OH, an alkoxy, aralkyloxy or aryloxy group having from 1 to 24 carbon atoms, —$OM_3$, where $M_3$ is a cation, an amino group, a morpholino group, a cyclic amino group, an alkylamino group, a dialkylamino group, an arylamino group or an alkyloxy group;

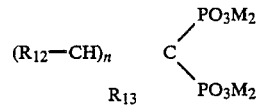

(X)

where $R_{12}$ and $R_{13}$ each represents a hydrogen atom, a lower alkyl group or an imino group, which may optionally be substituted by a lower alkyl group and/or —$CH_2CH_2COONa$;

M represents a hydrogen atom, an alkali metal or an ammonium group;

n represents an integer of from 2 to 16;

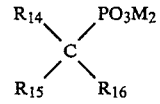

(XI)

where $R_{14}$ to $R_{16}$ each is a hydrogen atom or an alkyl group, which may have at least one substituent selected from —OH, —$OC_{n''}H_{2n''+1}$, where n'' is 1 to 4, —$PO_3M_2$, —$CH_2PO_3M$, —$NR_2$, where R is an alkyl group and —$N(CH_2PO_3M_2)_2$; and M represents a hydrogen atom, an alkali metal or an ammonium group.

5. A method for processing a silver halide color photographic material as in claim 4, in which the amount of the chelating agent in the developer is from 0.01 to 20 g per liter of the color developer.

6. A method for processing a silver halide color photographic material as in claim 1, in which the color developer contains 0.05 ppm or more metal ion.

7. A method for processing a silver halide color photographic material as in claim 1, in which the silver halide color photographic material has at least one emulsion layer substantially comprising silver chloride.

8. A method for processing a silver halide color photographic material as in claim 1, in which the amount of the compound of formula (I) in the color developer is from 0.01 to 50 g and the amount of the compound of formula (II) in the color developer is from 0.00005 to 0.1 mol.

9. A method for processing a silver halide color photographic material as in claim 5, in which the amount of the compound of formula (I) in the color developer is from 0.01 to 50 g and the amount of the compound of formula (II) in the color developer is from 0.00005 to 0.1 mol.

10. A method for processing a silver halide color photographic material as in claim 4, in which the opening ratio of the color developer is 0.20 $cm^{-1}$ or less.

11. A method for processing a silver halide color photographic material as in claim 4, in which the color developer contains 0.05 ppm or more metal ion.

12. A method for processing a silver halide color photographic material as in claim 4, in which the silver halide color photographic material has at least one emulsion layer substantially comprising silver chloride.

13. A method for processing a silver halide color photographic material as in claim 8, in which the opening ratio of the color developer is 0.20 $cm^{-1}$ or less.

14. A method for processing a silver halide color photographic material as in claim 8, in which the color developer contains 0.05 ppm or more metal ion.

15. A method for processing a silver halide color photographic material as in claim 1, in which the silver halide photographic material contains a cyan coupler represented by the following formula (C-I) and is processed in continuous processing:

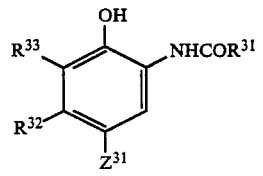

(C-I)

where $R^{31}$ represents an alkyl group, a cycloalkyl group, an aryl group, an amino group or a heterocyclic group;

$R^{32}$ represents an acylamino group or an alkyl group having 2 or more carbon atoms;

$R^{33}$ represents a hydrogen atom, a halogen atom, an alkyl group or an alkoxy group, or $R^{33}$ may be bonded to $R^{32}$ to form a ring;

$Z^{31}$ represents a hydrogen atom, a halogen atom or a group capable of being released by reaction with the oxidation product of an aromatic primary amine color developing agent.

16. A method for processing a silver halide color photographic material as in claim 15, wherein the amount of the cyan coupler is from 0.002 to 0.3 mol per mol of the light-sensitive silver halide in a photographic layer of the silver halide color photographic material.

* * * * *